US007296872B2

(12) United States Patent
Hayashi et al.

(10) Patent No.: US 7,296,872 B2
(45) Date of Patent: Nov. 20, 2007

(54) PRINTING APPARATUS AND METHOD OF ADJUSTING PRINTING POSITION

(75) Inventors: Aya Hayashi, Sendai (JP); Jiro Moriyama, Kawasaki (JP); Hidehiko Kanda, Yokohama (JP); Yuji Hamasaki, Kawasaki (JP); Norihiro Kawatoko, Kawasaki (JP); Toshiyuki Chikuma, Kawasaki (JP); Atsushi Sakamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/477,348

(22) Filed: Jun. 30, 2006

(65) Prior Publication Data

US 2007/0013726 A1 Jan. 18, 2007

(30) Foreign Application Priority Data

Jul. 8, 2005 (JP) ..... 2005-200147

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 5,956,055 | A * | 9/1999 | Gibson et al. | 347/40 |
| 6,084,606 | A | 7/2000 | Moriyama | |
| 6,371,592 | B1 | 4/2002 | Otsuka et al. | |
| 6,913,337 | B2 | 7/2005 | Kuronuma et al. | |
| 2004/0223024 | A1 * | 11/2004 | Mitsuzawa | 347/19 |
| 2006/0038842 | A1 | 2/2006 | Chikuma et al. | |
| 2006/0158476 | A1 * | 7/2006 | Ng et al. | 347/19 |
| 2007/0008360 | A1 | 1/2007 | Hayashi et al. | |
| 2007/0008361 | A1 | 1/2007 | Kawatoko et al. | |
| 2007/0013732 | A1 | 1/2007 | Sakamoto et al. | |

FOREIGN PATENT DOCUMENTS

| | | |
|---|---|---|
| EP | 674993 A2 * | 10/1995 |
| JP | 7-40551 | 2/1995 |
| JP | 7-309007 | 11/1995 |
| JP | 11-240143 | 9/1999 |
| JP | 2004-9489 | 1/2004 |

* cited by examiner

*Primary Examiner*—Matthew Luu
*Assistant Examiner*—Justin Seo
(74) *Attorney, Agent, or Firm*—Fitzpatrick, Cella, Harper & Scinto

(57) ABSTRACT

Image deterioration is suppressed as much as possible which is complexly generated by variations of printing positions respectively of printing elements in a printing element row and by displacement of printing positions among printing element rows. To this end, a first adjustment value for adjusting printing positions among a plurality of printing elements included in a printing element row is obtained. Next, printing positions among a plurality of printing elements are adjusted based on the first adjustment value. Then a second adjustment value for adjusting printing positions among not less than two of the printing element rows is obtained. Thereby variations of printing positions in a discharge port row and displacement of printing positions among discharge port rows are properly adjusted in different phases, and adverse effects generated by two kinds of different causes are collectively suppressed.

11 Claims, 41 Drawing Sheets

PRINTING APPARATUS AND METHOD OF ADJUSTING PRINTING POSITION

BACKGROUND OF THE INVENTION

1. Field of the Invention

The present invention relates to a printing apparatus in which an image is formed by applying a printing agent onto a printing medium from printing means having a plurality of printing elements arranged. In particular, the present invention relates to a method of, and a configuration for, adjusting printing position displacement of the printing elements.

2. Description of the Related Art

A printing apparatus having functions of a printer, a copier, a facsimile machine and the like, or a printing apparatus used as an outputting device of a complex electric device or a work station including a computer or a word processor is configured so that an image (including characters and the like) is printed on a printing medium such as paper and a plastic sheet based on image information (including character information and the like). Depending on the printing method, such a printing apparatus can be classified into an inkjet method, a wire dot method, a thermal method, a laser beam method and the like. Among the above, a printing apparatus using the inkjet method (an inkjet printing apparatus), which carries out printing by discharging inks from printing means (a printing head) onto a printing medium, has a number of superior characteristics when compared with other printing methods in that higher resolution is easily achieved, high speed printing is possible in an excellently silent state, and the price and costs are low. Thus, the inkjet printing apparatus has become popular in a wide range from office use to personal use.

In general, in an inkjet printing apparatus, a printing head, which is configured by integrally arranging a plurality of printing elements including ink discharge ports and liquid paths for supplying inks to the ink discharge ports, is used. In addition, to cope with color images, inkjet printing apparatus include printing heads for a plurality of colors in many cases.

FIG. 1 is a perspective view for describing an inner mechanism of a general inkjet printing apparatus. In FIG. 1, reference numeral 101 denotes ink cartridges. Here, four ink cartridges respectively storing black ink, cyan ink, magenta ink and yellow ink are prepared. Reference numeral 102 denotes a printing head, which is capable of discharging ink supplied from the ink cartridges 101 for the respective colors in the −Z direction in FIG. 1.

Reference numeral 106 denotes a carriage, which is capable of moving and scanning in the X direction in FIG. 1 with the ink cartridges 101 for the four colors and the printing head 102 mounted thereon. During the time when a printing operation is not carried out, or when a recovering operation of the printing head 102 or the like is carried out, the carriage 106 is caused to wait at a home position (h) shown by a dotted line in FIG. 1.

Reference numeral 103 denotes a paper conveying roller, which conveys a printing medium P to the sub-scanning direction which is the Y direction by rotating with spurs 104 while supporting the printing medium P. Reference numeral 105 denotes a pair of paper feeding rollers, which feeds the printing medium P, and which plays a role of pressing the printing medium P in common with the paper conveying roller 103 and the spurs 104.

The carriage 106 is in the h position (home position) in FIG. 1 before starting printing, and moves and scans in the X direction when a printing start instruction is received. At the same time, the printing head 102 carries out discharge of inks according to printing signals. The discharged ink droplets are placed on the printing medium P. When finishing printing on the printing medium up to an end portion positioned on the opposite side of the home position, the carriage 106 returns to the original home position, and repeats printing in the X direction again. Otherwise, printing can be carried out by the carriage 106 moving and scanning in the −X direction without returning to the home position. When the printing scanning for one time has been completed, the printing medium P is conveyed by the pair of paper feeding rollers 105 and the paper conveying roller 103 by a predetermined amount in the Y direction. By intermittently repeating the printing scanning and the conveyance operation as described above, an image is sequentially formed on the printing medium P.

FIG. 2 is a schematic view for describing an arrangement state of the discharge ports for two colors which are observed in a case where the printing head 102 is viewed from the Z direction. In FIG. 2, reference numeral 201 denotes one discharge port of a discharge port row A for discharging black ink, and reference numeral 202 denotes one discharge port of a discharge port row B for discharging cyan ink. In FIG. 2, the discharge port rows A and B respectively have discharge ports of L=12, and each of the ink discharge ports is arranged at 1/600-inch intervals in the Y direction. Therefore, ink is discharged from each of the discharge ports while the printing head 102 is moving in the X direction, so that an image is formed with a printing density of 600 dpi (dot/inch) in the Y direction. In FIG. 2, n1 to n12 are reference numerals denoting arrangement positions of the respective discharge ports. The ink discharge port 201 is n12 in the discharge port row A, and the ink discharge port 202 is n1 in the discharge port row B.

In the present example, an amount of ink discharged from each of the discharge ports is set at approximately 2 pl per a droplet. In addition, a discharge frequency for stably discharging this amount of the ink droplet is set at 30 KHz, and a discharge speed is set at approximately 20 m/sec. In addition, a speed in the main scanning direction (X direction) of the carriage 106 on which the printing head 102 such as the above is mounted is approximately 25 inch/sec. With this, an image is formed with a printing density of approximately 1200 dpi in the main scanning direction.

Incidentally, in the printing head 102 such as the above having a general configuration, it has been heretofore known that displacement of dots is caused on a printing medium mainly for the following reasons. First, nozzle rows for a plurality of colors vary due to inaccuracy in manufacturing. Second, the printing head 102 is inaccurately installed to the carriage 106 when mounting the printing head 102 to the carriage 106. Third, a timing gap occurs in a case where main printing scanning is bi-directionally carried out. Then, to correct such displacement of dot placement, various printing position adjusting means and methods have been already proposed and implemented.

A printing position adjusting method applied to an inkjet printing apparatus will be described below. In general, in an inkjet printing apparatus, a printing position adjusting mode is included for adjusting dot placement prior to carrying out a normal printing operation.

FIG. 3 is a flowchart for describing each process carried out by an inkjet printing apparatus and a user at the time of performing the printing position adjustment.

First, when a printing position adjusting mode is designated, the printing apparatus prints predetermined check patterns on a printing medium in Step S4601.

FIG. 4 is a diagram showing one example of the check patterns outputted in Step S4601. Here, nine patterns printed in the following manner are shown. Timing of discharge from the discharge port row B is shifted from timing of discharge from the discharge port row A on a pixel-by-pixel basis from +4 pixels to −4 pixels in order to align the dot placement from the discharge port rows A and B arranged in the printing head 102. In the printing apparatus in this example, adjusting resolution for aligning printing positions of the discharge port rows A and B is set at one pixel out of 1200 dpi(dot/inch), that is, approximately 21 μm, and each pattern is printed with a resolution equal to the adjusting resolution.

FIG. 5 is a view showing that patterns obtained by shifting the two timing respectively by +2 to 0 pixels, out of the nine patterns shown in FIG. 4, on an enlarged scale. In FIG. 5, black circles and white circles are dots printed by the discharge port row A and the discharge port row B, respectively. Since the black circle dots printed by the discharge port row A are placed by discharging ink at the same timing, the black circle dots are printed in the same position in the main scanning direction. In contrast, since the white circle dots printed by the discharge port row B are placed by discharging ink at the timing of being shifted for one pixel, the while circle dots are also placed by being shifted on a pixel-by-pixel basis in the scanning direction in each of the printed patterns. In the present patterns, + direction shows a state where the printing head discharges ink at further delayed timing while the printing head is moving in the main scanning direction.

In the patterns shown in FIGS. 4 and 5, a state shown by +1 becomes a state where lines formed by the two discharging rows are overlapped most, which is recognized as a pattern close to a straight line. That is, it can be determined that the discharging timing of the discharge port rows A and B are in a most congruent state. In contrast, in a state shown by +2 or 0, distances d1 and d3 between the two lines are printed at approximately 21-μm intervals, though the lines are in the opposite directions.

Referring to FIG. 3 again, in the following Step S4602, the user selects a pattern, which is the closest to a straight line, of the nine patterns to enter the information from the printing apparatus, the host computer connected thereto, or the like. In the present example, as described above, it can be determined that the pattern of +1 is the closest to a straight line, and the user enters this information.

In Step S4603, the printing apparatus stores the information entered in Step S4602 in a memory (for example, a rewritable non-volatile memory such as an EEPROM) in the main body. By this, the printing position adjusting mode has been completed.

When printing is next carried out, the printing apparatus adjusts discharging timing of the discharge port rows A and B based on the information stored in the memory. By this, an image can be formed in a state where the printing positions of the two discharge port rows A and B are optimized.

The method of adjusting printing positions of the discharge port rows A and B has been described above. However, in a case where inks of a plurality of colors are discharged, or where a printing head having a plurality of discharge port rows for each color is used, printing position adjustment is needed for further more discharge port rows. In such a case, it can be addressed by having a configuration in which timing of each of the discharge port rows is adjusted by synchronizing with the timing of the discharge port row A as a reference and the respective adjustment value data are stored. In addition, even though a single discharge port row is used, in a case of bi-directional printing where discharge is carried out in the forward and backward movements of the carriage, a printing adjusting mode for adjusting the timing of discharge in the forward movement and the timing of discharge in the backward movement can also be achieved by a similar pattern and flowchart.

By the above-described conventional printing adjusting method, it has been possible to adjust printing positions between the plurality of discharge port rows and printing positions at the time of the bi-directional printing. However, it has not been possible to adjust printing positions in a single row. In recent inkjet printing apparatuses, demand for high-definition images comparable to film photos has increased, and further minimization of droplets and further enhancement of high-definition of the printing element arrangement have been in progress. Then, in such circumstances, situations have arisen where slight position displacement or a slight inclination of the discharge port row arranged in one row on the printing head cannot be neglected. In particular, an inclination of the discharge port row largely affects an image.

Under such circumstances, several methods of correcting adverse effects on an image due to an inclination of a printing head have been invented. In Japanese Patent Application Laid-open No. 7-309007, there has been disclosed an inkjet print system in which a displacement correcting circuit is provided to add offsets to image data to be printed by each discharge port in order to reduce displacement of printing positions caused by rotation of a printing head. In addition, in Japanese Patent Application Laid-open No. 7-40551, there has been disclosed an inkjet printing apparatus in which a plurality of discharge port rows arranged on a printing head is divided into a plurality of blocks so as to adjust the discharging order and intervals of each discharging block according to the inclination. Moreover, in Japanese Patent Application Laid-open No. 11-240143, there has been disclosed a method to correct displacement of printing positions in joint portions of each printing scanning caused by the inclination of the head. For that purpose, first, an offset amount is set from a displacement amount between a printing position by the discharge port on the uppermost portion and a printing position by the discharge port on the lowermost portion. After that, for one portion of the discharge ports, printing is carried out by shifting data by an amount based on the offset amount. Moreover, in Japanese Patent Application Laid-open No. 2004-9489, there has been disclosed an inkjet printing apparatus having means for changing allocation of data to be printed by each discharge port according to the inclination of the printing head.

However, in a conventional inkjet printing apparatus, though it has been possible to correct the inclination of a printing head or each of printing position displacement between respective discharge port rows, batch correction of complex printing position displacement caused by various causes has been difficult. For example, when the above-described printing position adjustment between respective rows is carried out, there has been a disadvantage that normal adjustment cannot be achieved because the user is confused or cannot select a proper value when it is in the state of including inclination in each discharge port row.

The above-described problem will be briefly described below.

FIG. 6 is a view showing a configuration similar to the configuration shown in FIG. 2 but having the printing head 102 with an inclination θ in each of two discharge port rows. In the present example, n1 of the discharge port row A is arranged in the position away from n12 by approximately 63 μm in the +X direction. This distance corresponds to a distance for approximately three pixels in the printing apparatus in which printing is carried out at 1200 dpi. On the other hand, n1 of the discharge port row B is arranged in the position away from n12 by approximately 63 μm in the −X direction. This distance also corresponds to a distance for approximately three pixels in the printing apparatus in which printing is carried out at 1200 dpi.

FIG. 7 is a diagram showing a printing state where check patterns similar to those in FIG. 4 are printed by using the printing head shown in FIG. 6.

FIG. 8 is a view showing that patterns of −1 to −3, out of the nine patterns shown in FIG. 7, on an enlarged scale. In FIG. 7 and FIG. 8, there is no case where lines by the two discharge port rows are recognized as a straight line like the pattern of +1 shown in FIGS. 4 and 5. The case where the distance between the two lines actually becomes the smallest is the pattern of −2. However, even in this state, displacement of d2=63 μm at maximum is caused between the discharge port rows A and B. Then, in the patterns of −1 and −3 in which timing is shifted by one pixel from the pattern of −2, displacement of approximately 84 μm is caused in the opposite directions.

In this manner, in a case of the discharge port row having the inclination shown in FIG. 6, a difference of each pattern is difficult to be determined, and it is difficult for the user to select the proper pattern of −2. In addition, even in a case where the proper value −2 is selected, the printing positions of the two discharge port rows are kept including the displacement of approximately 63 μm in an image to be outputted thereafter.

Such displacement of dot placement in the discharge port row is caused by inaccuracy at the time of manufacturing a printing head, inaccuracy at the time of mounting the printing head on the carriage, an inclination of the discharge port face against a flat surface of the printing medium, or the like. Therefore, a printing apparatus or a printing head is manufactured with consideration of avoiding generating such inaccuracy as much as possible at the time of manufacturing or mounting thereof. However, slight inaccuracy caused in spite of such an effort to suppress is not allowed for a demanded high-definition image recently. The problem due to the inclination of the discharge port row has become a major problem in recent inkjet printing apparatuses in which discharge of small droplets is achieved.

SUMMARY OF THE INVENTION

The present invention has been made in view of the forgoing problems. Accordingly, the present invention can provide a printing apparatus and a method of adjusting printing positions with which image deterioration is suppressed as much as possible. The image deterioration is complexly caused by inaccuracy in discharge port rows occurred during manufacturing of a printing apparatus and mounting of a printing head, and displacement of printing positions among the discharge port rows.

In a first aspect of the present invention is a printing apparatus for forming an image by moving and scanning a plurality of printing element rows relatively to a printing medium, each of the printing element rows being formed by arranging a plurality of printing elements applying color agents onto the printing medium, comprises first adjusting means for obtaining a first adjustment value for adjusting printing positions among a plurality of printing elements included in a predetermined one of the printing element rows; and second adjusting means for obtaining a second adjustment value for adjusting printing positions among not less than two of the printing element rows, which are predetermined, wherein the second adjusting means obtains the second adjustment value based on the first adjustment value.

The second aspect of the present invention is a method of adjusting printing positions of a printing apparatus for forming an image by moving and scanning a plurality of printing element rows relatively to a printing medium, each of the printing element rows being formed by arranging a plurality of printing elements applying color agents onto the printing medium, comprising the steps of: obtaining a first adjustment value for adjusting printing positions among a plurality of printing elements included in a predetermined one of the printing element row; and obtaining a second adjustment value for adjusting printing positions among not less than two of the printing element rows, which are predetermined, wherein the second adjustment value is obtained based on the first adjustment value.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
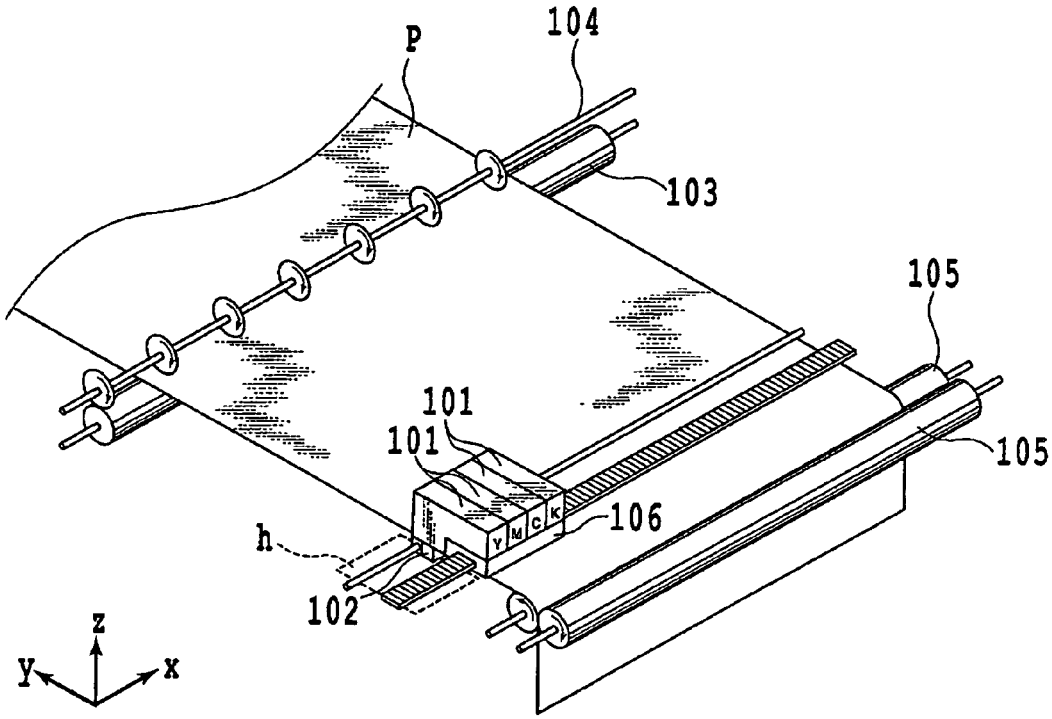
FIG. 1 is a perspective view for describing an inner mechanism of a general inkjet printing apparatus.
Figure 2:
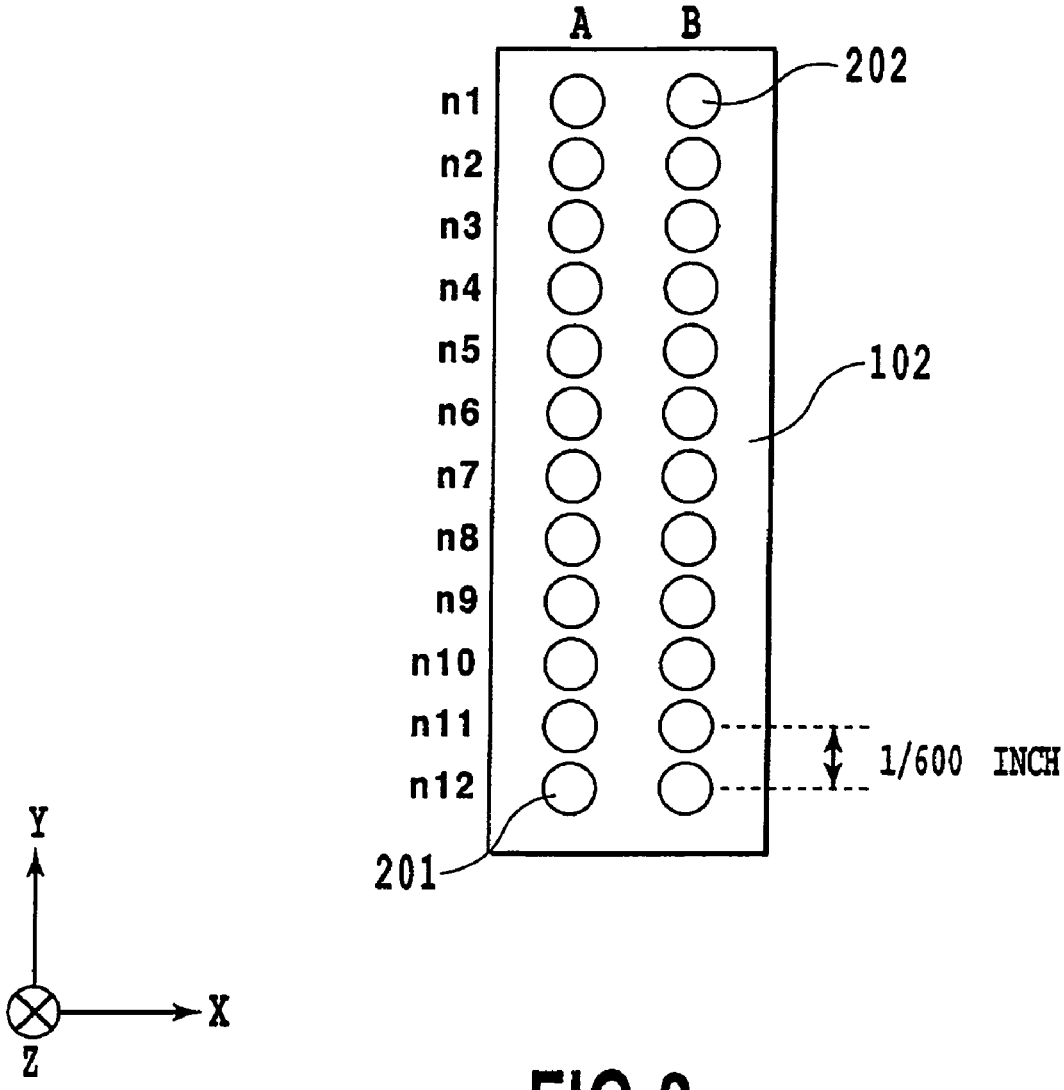
FIG. 2 is a schematic view for describing an arrangement state of discharge ports for two colors in a printing head.
Figure 3:
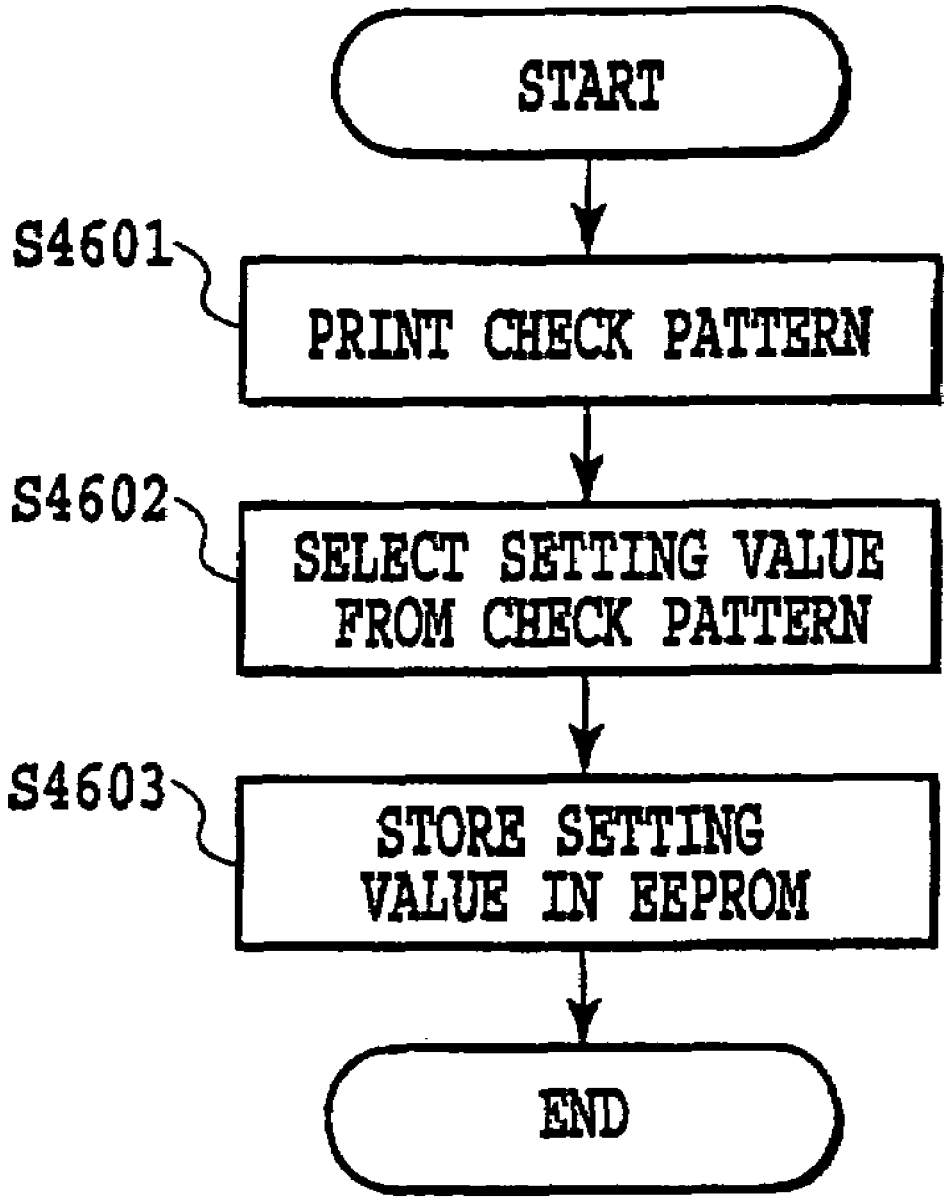
FIG. 3 is a flowchart for describing each process carried out by the inkjet printing apparatus and a user at the, time of carrying out a conventional printing position adjusting mode.
Figure 4:
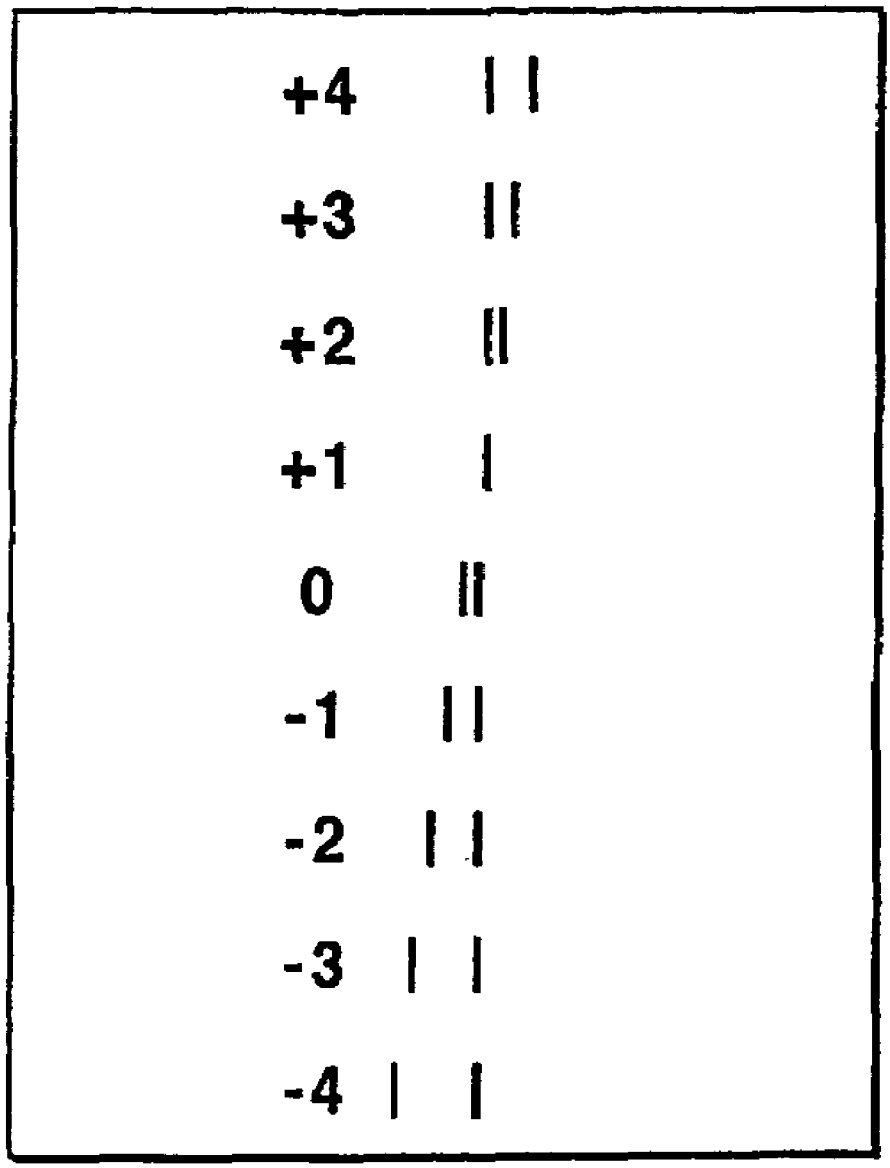
FIG. 4 is a diagram showing one example of check patterns in the conventional printing position adjusting mode.
Figure 5:
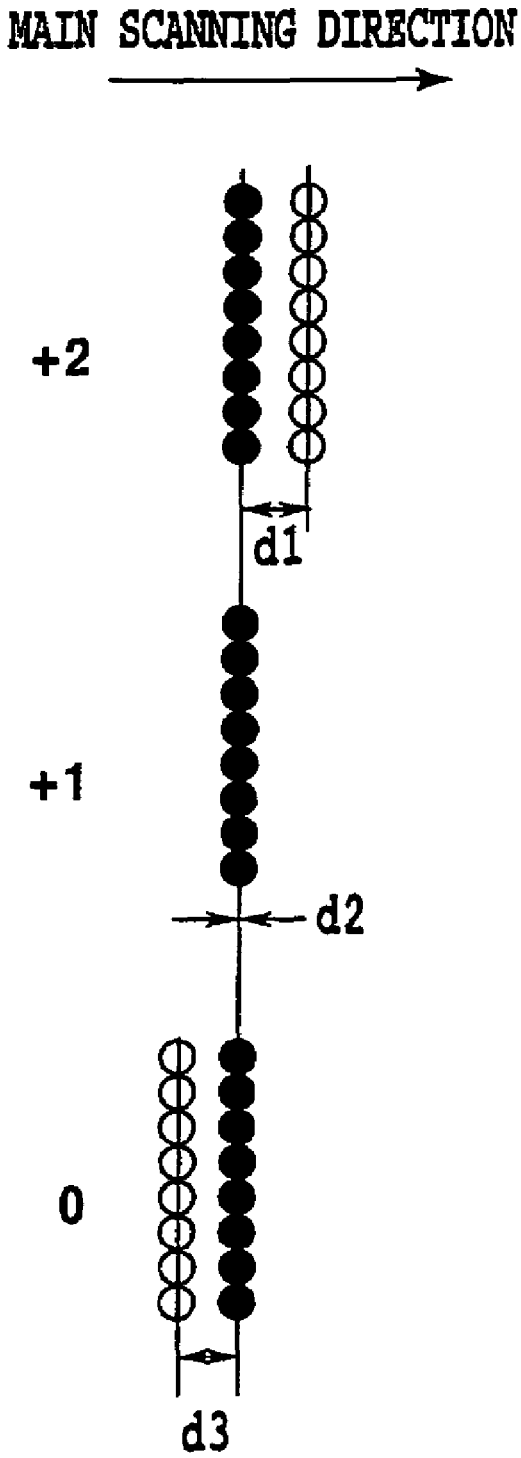
FIG. 5 is a view showing patterns of +2 to 0 pixels, out of the nine patterns shown in FIG. 4, on an enlarged scale.

Detailed description of an embodiment of the present invention will be given below by applying an inkjet printing apparatus shown in FIG. 1.

Figure 9:
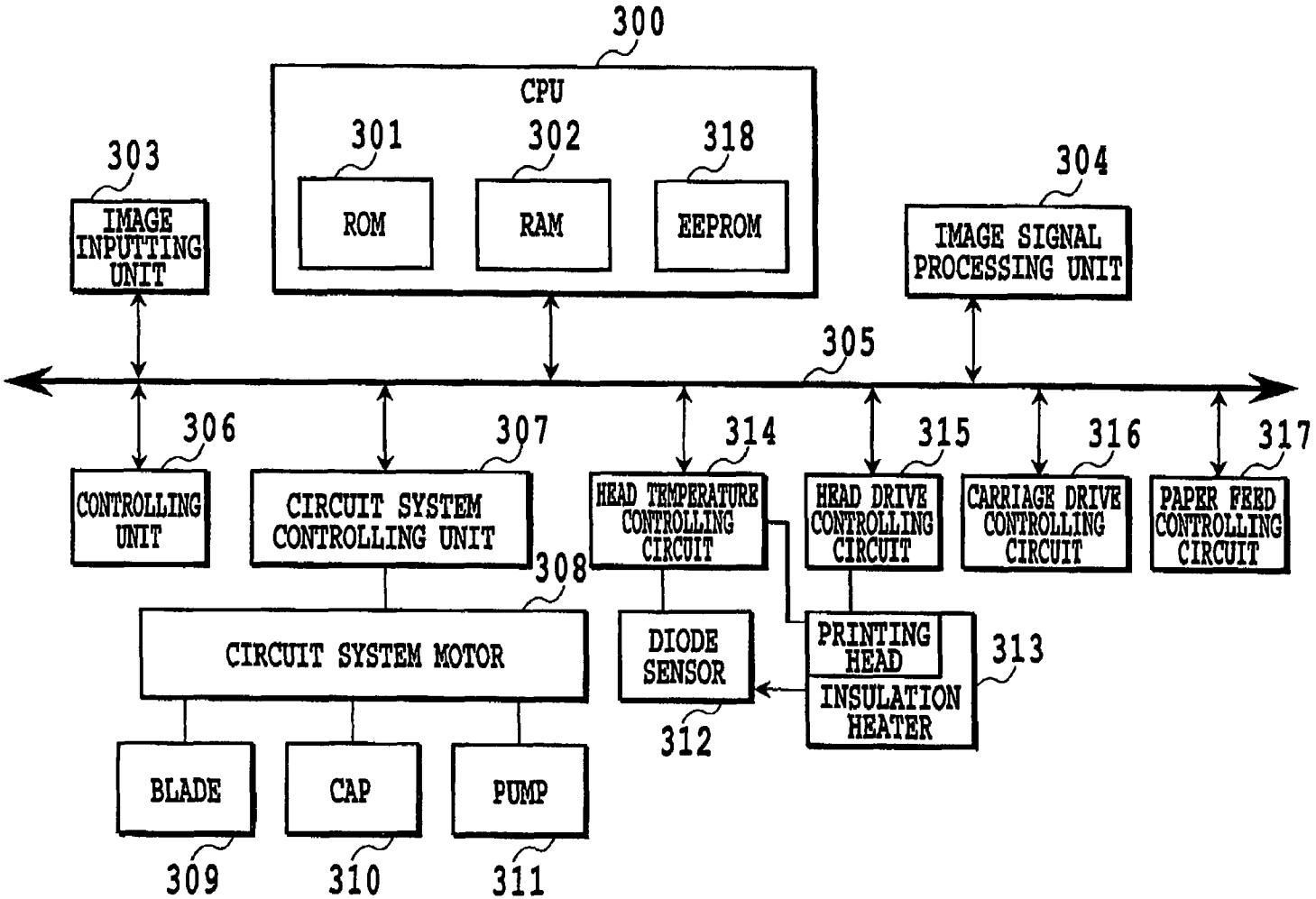
FIG. 9 is a block diagram for describing a configuration of control in an inkjet printing apparatus capable of being applied to an embodiment of the present invention.

FIG. 9 is a block diagram for describing a configuration of control in the inkjet printing apparatus in the present embodiment. In FIG. 9, reference numeral 305 denotes a main bus line. Software system processing means such as an image input unit 303, an image signal processing unit 304 and a central processing unit CPU 300, and hardware system processing means such as an operation unit 306, a recovering system controlling circuit 307, a head temperature controlling circuit 314, a head drive controlling circuit 315, a carriage drive controlling circuit 316 in the main scanning direction, and paper feed controlling circuit 317 in the sub-scanning direction, are accessible to one another through the main bus line 305.

The CPU 300 includes a ROM 301, a RAM 302, and an EEPROM 318. Various kinds of programs carried out by the CPU are stored in the ROM 301. The CPU 300 carries out total control of the printing apparatus by using these memories and the like.

For example, the CPU 300 carries out predetermined processing to image data entered from the image input unit 303, while using the image signal processing unit 304. In addition, according to the acquired image signals, the CPU 300 controls the head drive controlling circuit 315 and various kinds of controlling circuits. The head drive controlling circuit 315 drives each of printing elements provided to the printing head 313 so as to discharge ink from each of discharge ports to achieve printing.

Moreover, the CPU 300 controls the head drive controlling circuit 315 and the recovering system controlling circuit 307 so as to carry out preliminary discharge and a recovery operation for preparing a discharge state of the printing head 313. The recovering system controlling circuit 307 drives a recovering system motor 308. By this, a pump 311 for forcibly aspirating ink from the discharge ports of the printing head, a cap 310 for suppressing ink evaporation from the discharge ports, and a blade 309 for scraping down stains on surfaces of the discharge ports, are respectively operated.

In the printing head 313, a diode sensor 312 for detecting a temperature of the printing head 313 and an insulation heater are provided. The head temperature controlling circuit 314 controls the insulation heater so that a temperature of the printing head 313 is kept in a predetermined range according to temperature information obtained from the diode sensor 312.

By using the above-described inkjet printing apparatus, a printing position adjusting method and a configuration, being characteristics of the present invention, will be described below by using several embodiments.

First Embodiment

Figure 6:
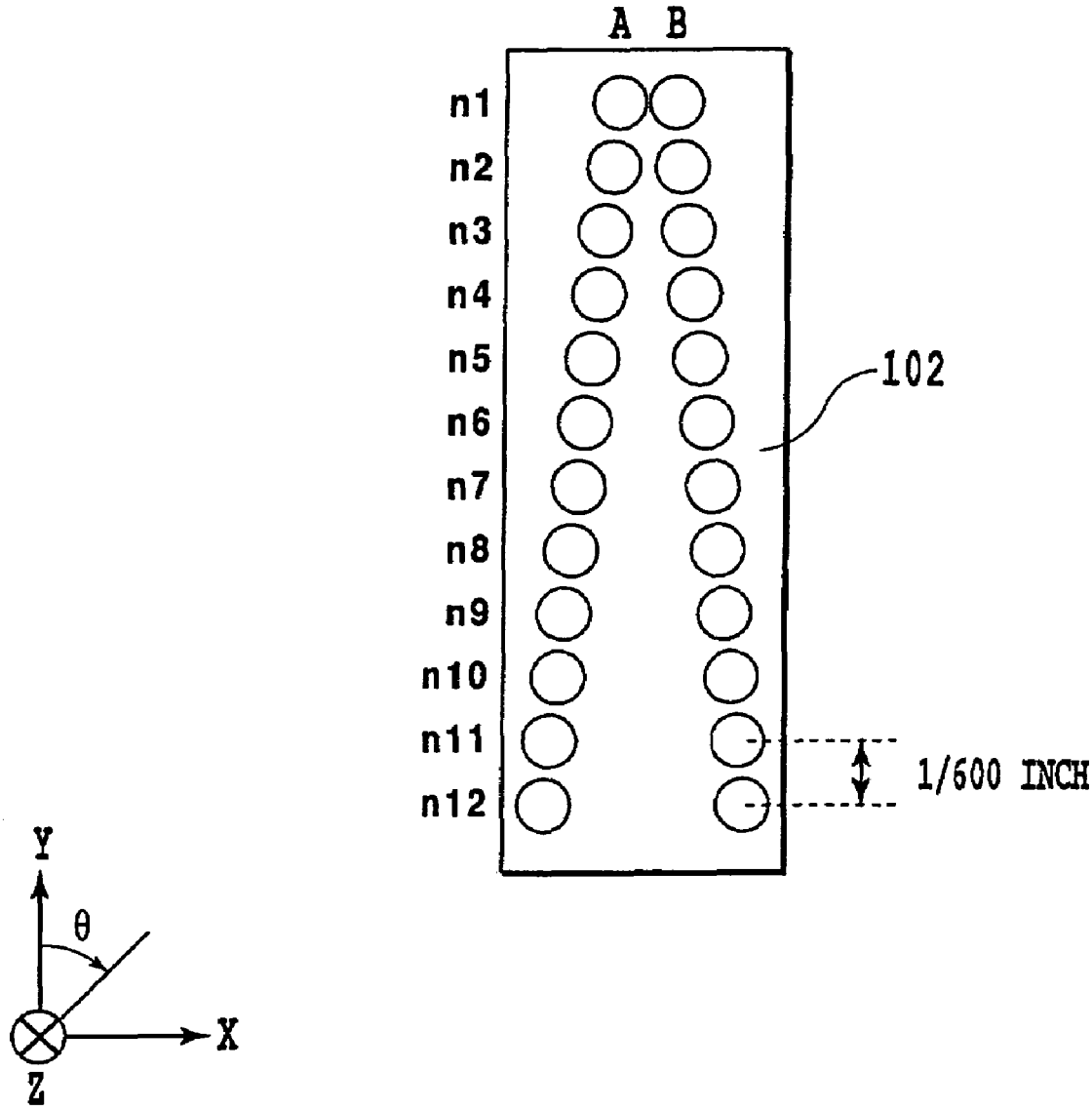
FIG. 6 is a view showing a printing head having inclination θ in each of the two discharge port rows.

In the present embodiment, as shown in FIG. 6, a printing head having discharge port rows A and B, which respectively include a reversely directed inclination θ, is applied. In such a state, even in a case where a straight line parallel with the conveyance direction of a printing medium is printed, the line printed on the paper includes the inclination θ, resulting in an image with poor linearity.

Figure 10:
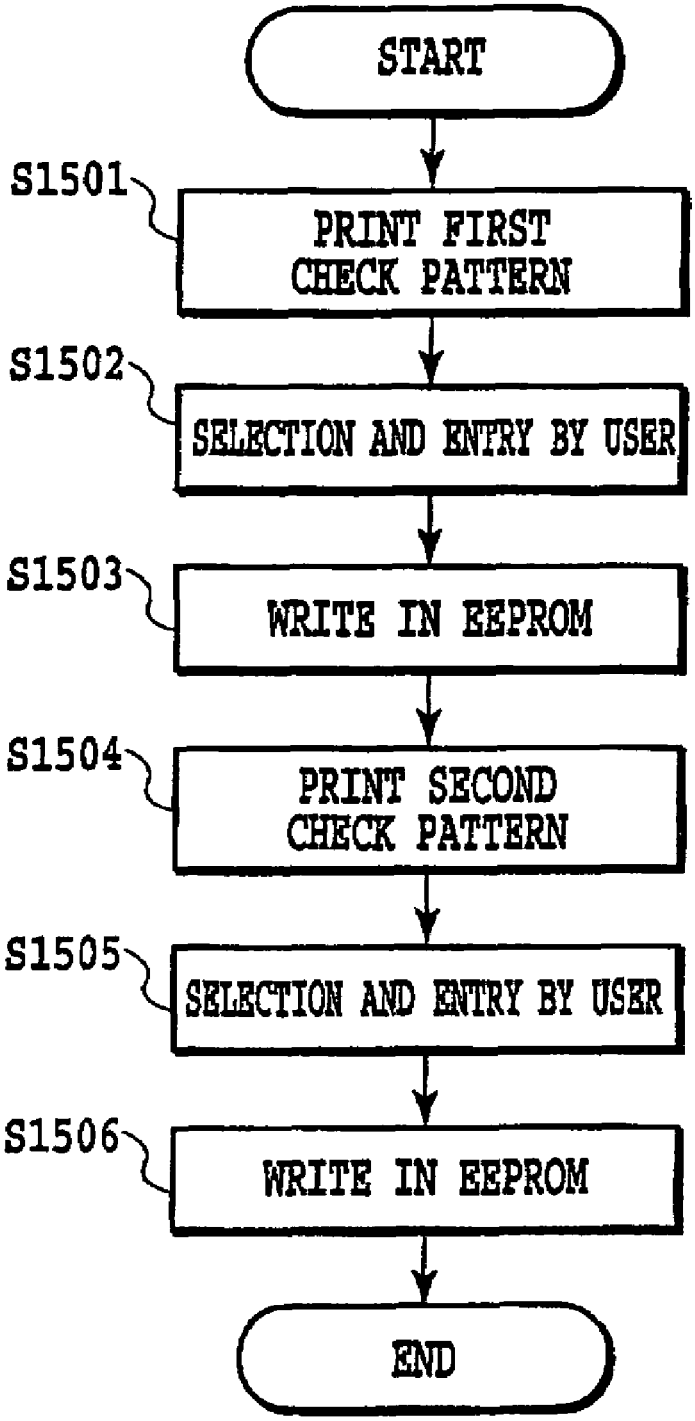
FIG. 10 is a flowchart for describing each process carried out by a CPU and a user at the time of carrying out printing position adjusting mode in the inkjet printing apparatus of a first embodiment.

FIG. 10 is a flowchart for describing each process carried out by a CPU 300 and a user at the time of carrying out a printing position adjusting mode in an inkjet printing apparatus of the present embodiment. When the printing position adjusting mode is started, according to the controlling by CPU 300, the printing head first prints first check patterns in Step S1501.

Figure 11:
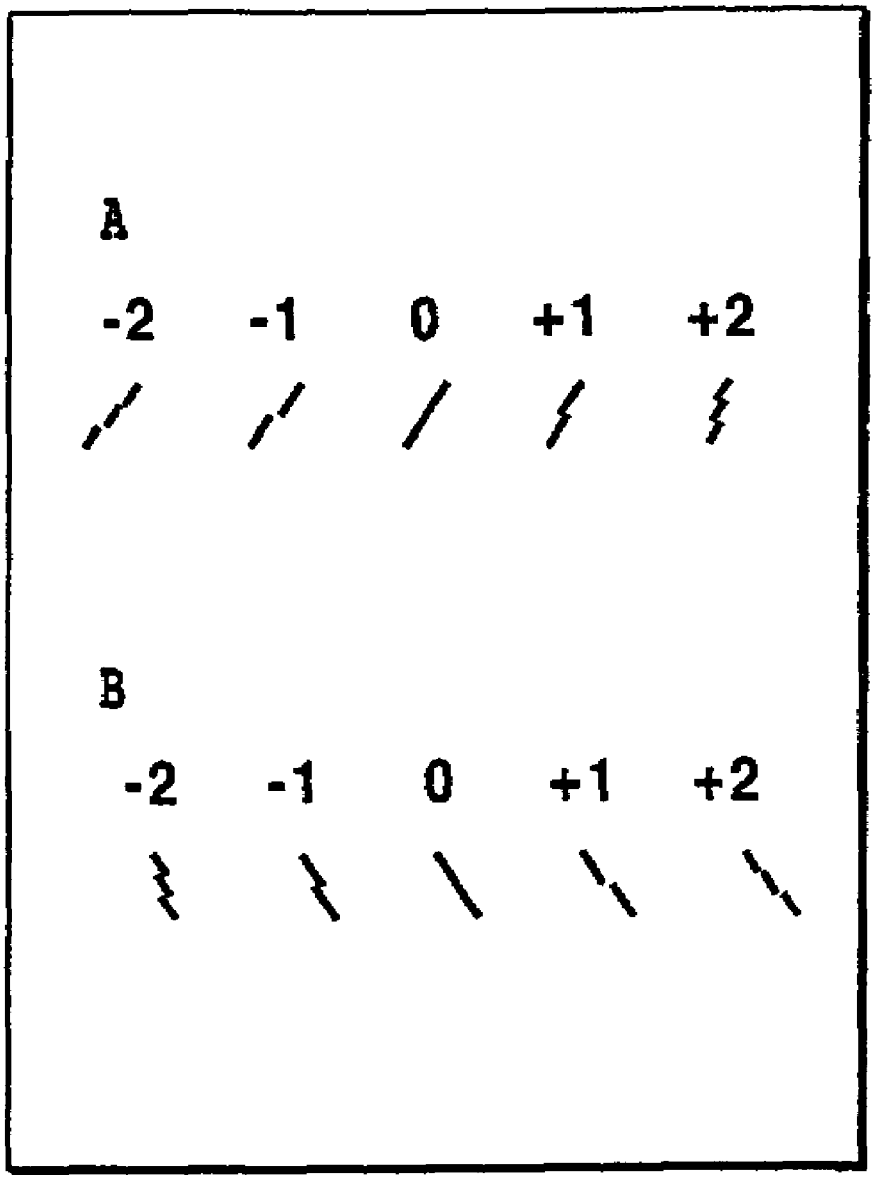
FIG. 11 is a diagram showing first check patterns for printing position adjustment applied in the first embodiment.

FIG. 11 is a view showing the first check patterns for printing position adjustment applied in the present embodiment. The first check patterns are patterns for correcting inclinations of positions, which are printed by a plurality of discharge ports included in one discharged port row, for each discharge port row. In FIG. 11, patterns A are patterns for correcting an inclination of discharge port row A, while patterns B are patterns for correcting an inclination of discharge port row B.

Figure 12A:
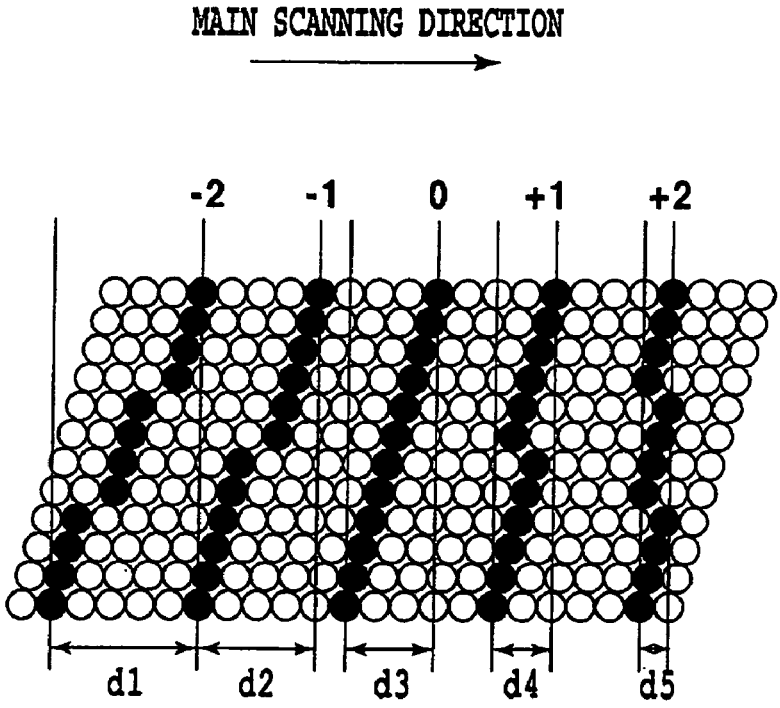
FIGS. 12A and 12B are schematic views in which patterns A and B in FIG. 11 are respectively shown in an enlarged scale.
Figure 12B:
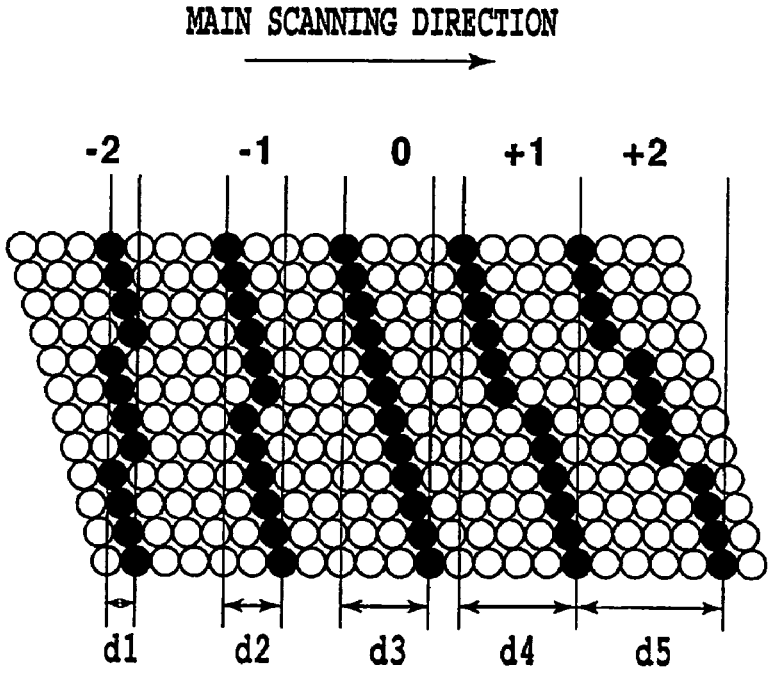

FIGS. 12A and 12B are schematic views showing that the patterns A and B in FIG. 11 are respectively enlarged. In the present embodiment, adjustable resolving power is 1200 dpi (approximately 21 μm), and each pixel is arranged with resolution adapted to this resoling power in FIG. 12A and 12B. Here, black circles and white circles show pixels that ink is printed by the printing head and that ink is not printed, respectively. The printing head of the present embodiment is configured so that timing of discharge from each discharge port can be adjusted for each group.

Figure 13:
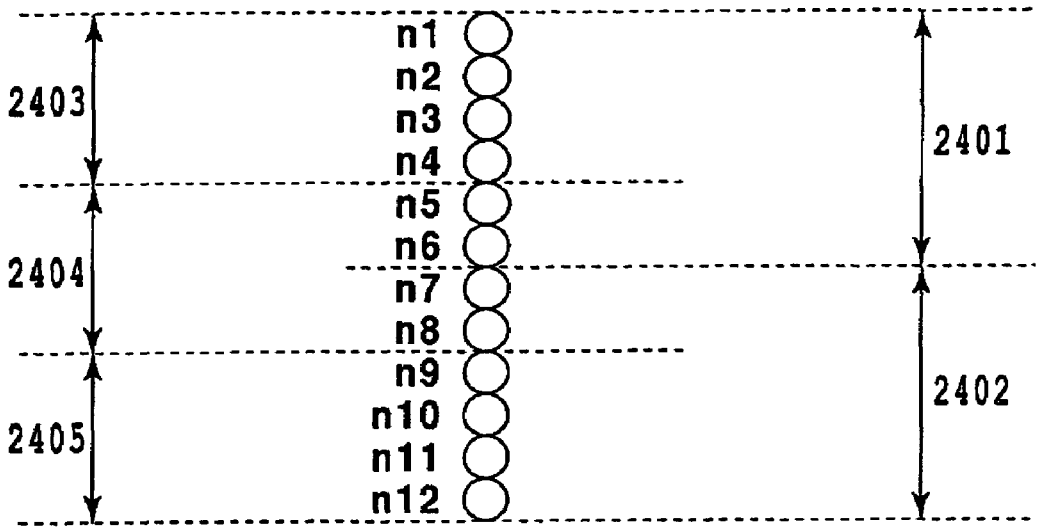
FIG. 13 is a schematic view showing one example that one discharge port row is divided into a plurality of groups.

FIG. 13 is a schematic view showing an example that one discharge port row is divided into a plurality of groups. Reference numerals 2401 and 2402 show an example that a discharge port row is divided into two groups. In this case, the discharge port group 2401 includes n1 to n6 discharge ports, and the discharge port group 2402 includes n7 to n12 discharge ports. The discharge port groups 2401 and 2402 can discharge ink at timing different from that of the other. On the other hand, reference numerals 2403 to 2405 show an example that a discharge port row is divided into three groups. In this case, the discharge port group 2403 includes n1 to n4 discharge ports, the discharge port group 2404 includes n5 to n8 discharge ports, and further the discharge port group 2405 includes n9 to n12 discharge ports.

In FIG. 12A, each of patterns of −2 to +2 is printed at timing when shifting another discharge port group by one pixel, by using the discharge port group 2401 or 2403 as a reference. Here, + direction is a state where printing is carried out at later timing than the reference discharge port group, while − direction is a state where printing is carried out at faster timing than the reference discharge port group. In FIG. 12A, the pattern of 0 shows a state where discharge is simultaneously carried out without shifting the timing in each discharge port group.

The patterns of +1 and −1 show states where printing is carried out by shifting the discharge port group 2402 by one pixel relatively to the discharge port group 2401. In addition, the patterns of +2 and −2 show states where printing is carried out by shifting the discharge port group 2404 by one pixel relatively to the discharge port group 2403 and by further shifting the discharge port group 2405 by one pixel. As can be recognized from FIG. 12A, in the discharge port row A, a preferable image with the smallest inclination can be obtained in a state where printing is carried out with the group division and timing shown in the pattern of +2.

It should be noted that in the patterns of the discharge port row B shown by FIG. 12B, the inclination direction is reversed from that of the discharge port row A, and a distance between two pixels also shows reversely directed behavior relatively to a correction amount. That is, in the discharge port row B, a preferable image with the smallest inclination can be obtained in a state where printing is carried out with the group division and timing shown in the pattern of −2.

Returning to FIG. 10 again, in Step S1502, the user observes the first check patterns and selects patterns with the smallest inclination for the patterns A and B, respectively. That is, the pattern of +2 for the patterns A and the pattern of −2 for the patterns B are selected, and the information is entered from the printing apparatus or the host computer or the like connected to the printing apparatus.

In the following Step S1503, the CPU 300 stores each of the two pieces of entered information in a different region in the EEPROM 318 in the printing apparatus.

Next, according to the controlling from the CPU 300, the printing head prints second check patterns in Step S1503.

Figure 14:
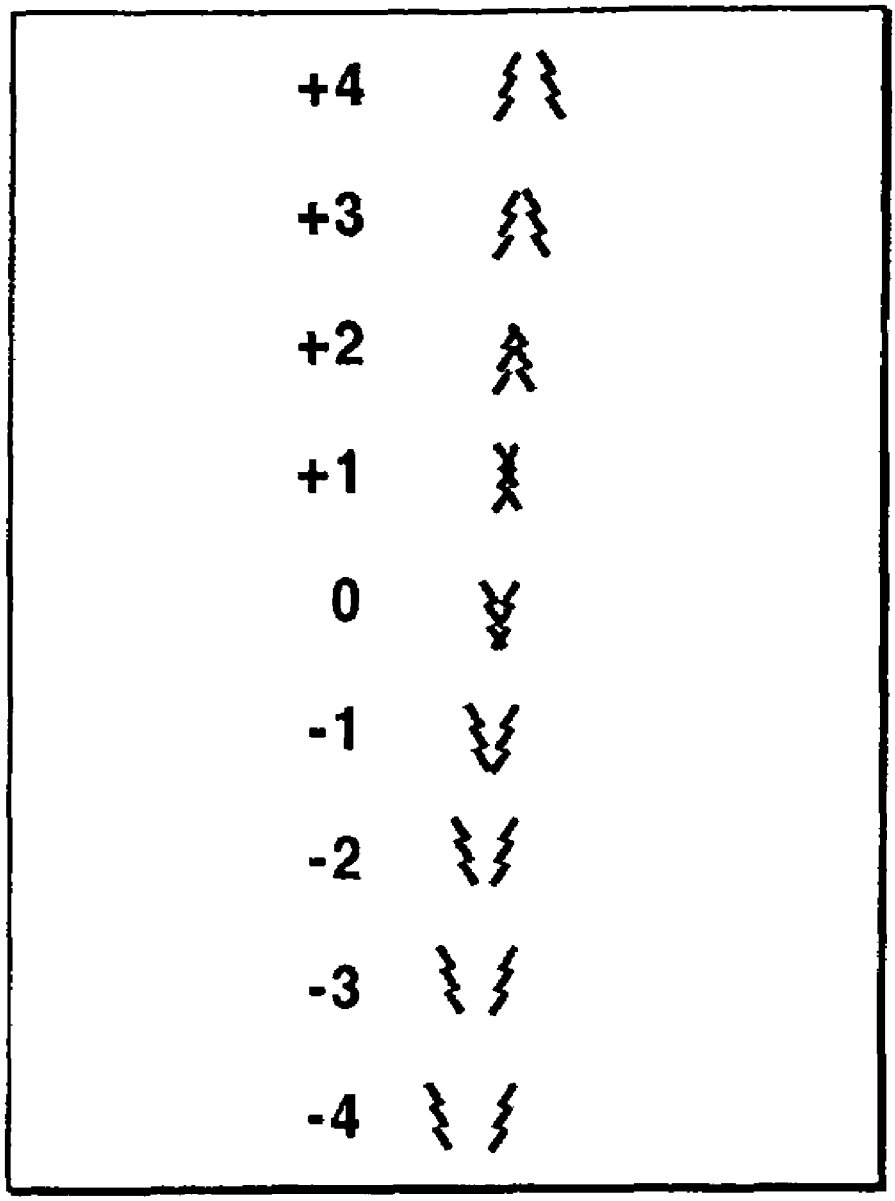
FIG. 14 is a diagram showing second check patterns for printing position adjustment applied in the first embodiment.

FIG. 14 is a view showing second check patterns for printing position adjustment applied in the present embodiment. The second check patterns are printed in a state where an inclination is corrected by the information stored in Step S1503, and after that, printing positions of the discharge port rows A and B are adjusted. Here, nine patterns, in which discharging timing of the discharge port rows A and B is shifted in a phased manner, are printed.

Figure 15:
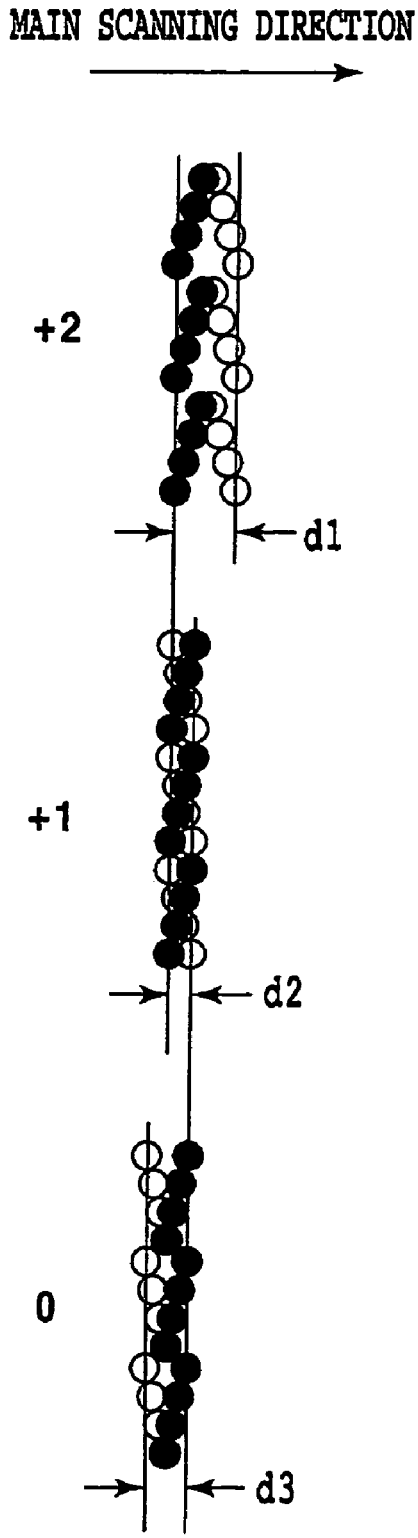
FIG. 15 is a schematic view showing patterns of 0 to +2, out of the nine patterns shown in FIG. 14, on an enlarged scale.

FIG. 15 is a schematic view showing that patterns of 0 to +2 of the nine patterns shown in FIG. 14 are enlarged. In FIG. 15, black circles and white circles show dots that ink is printed by the discharge port row A and that ink is printed by the discharge port row B, respectively. The timing of discharge from each discharging port row can be further adjusted on a pixel-by-pixel basis after correcting an inclination θ by the first check patterns. Here, + direction shows a state where printing by the discharge port row B is carried out at later timing than the discharge port row A, while − direction shows a state where printing by the discharging port row B is carried out at faster timing than the discharge port row A. The pattern of 0 shows a state where printing is carried out by the two discharge port rows without shifting the timing. The pattern of +1 shows a state where printing is carried out by shifting the discharge port row B by one pixel relatively to the discharge port row A. The pattern of +2 shows a state where printing is carried out by shifting the discharge port row B by two pixels relatively to the discharge port row A.

In this manner, by shifting discharging timing of each discharge port row in a phased manner, a distance between two pixels in the most distant positions in each discharge port row is also varied in a phased manner. For example, the distance d3 which nearly equals to 42 μm in the pattern of 0 is reduced to the distance d2 which nearly equals to 21 μm in the pattern of +1, and increases again to the distance d1 which nearly equals to 42 μm in the pattern of +2. In the present example, a preferable image most superior in linearity can be obtained in a state where printing is carried out at the timing shown in the pattern of +1.

Figure 7:
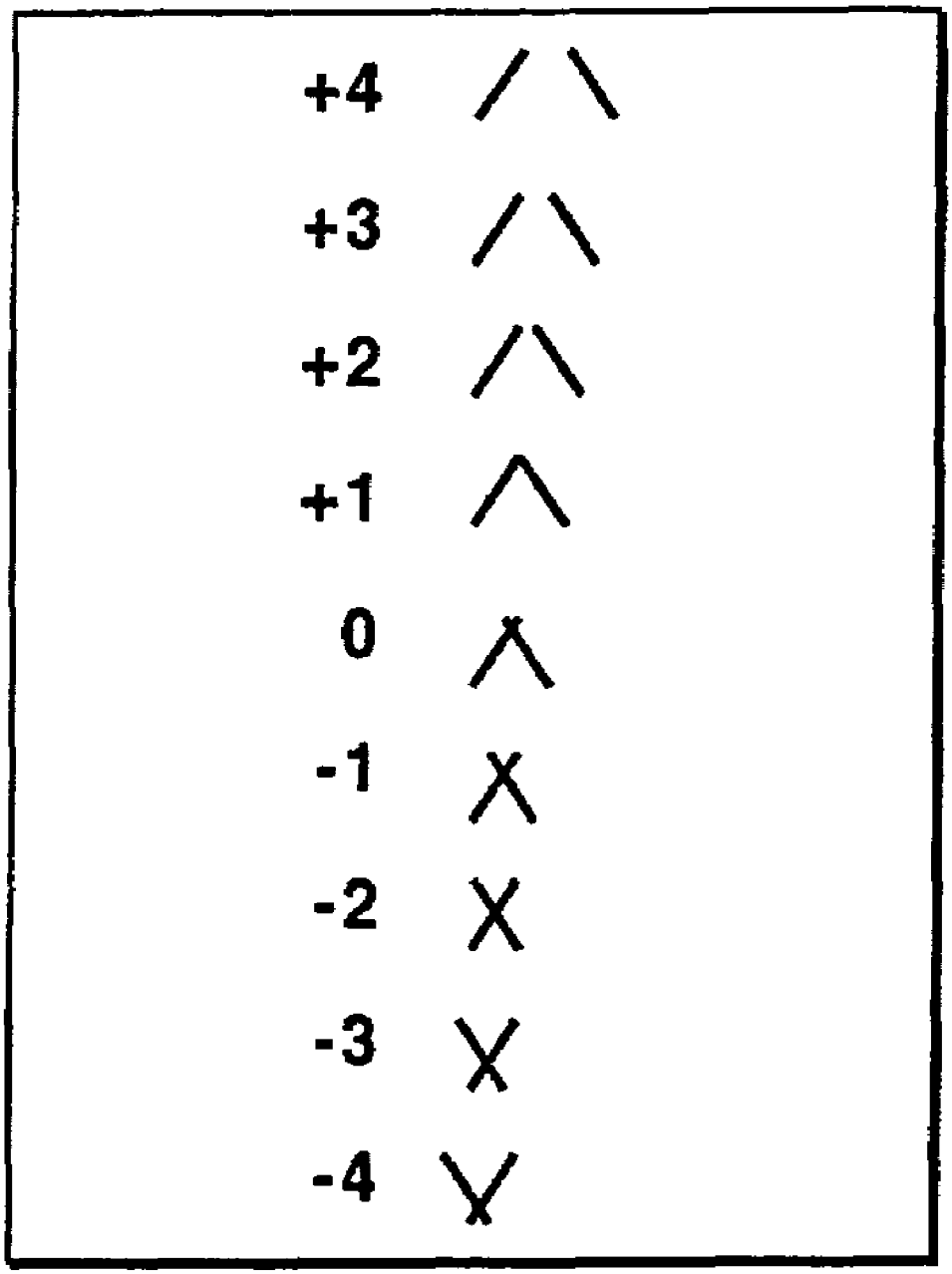
FIG. 7 is a diagram showing a printing state in which check patterns similar to FIG. 4 are printed by using the printing head shown in FIG. 6.
Figure 8:
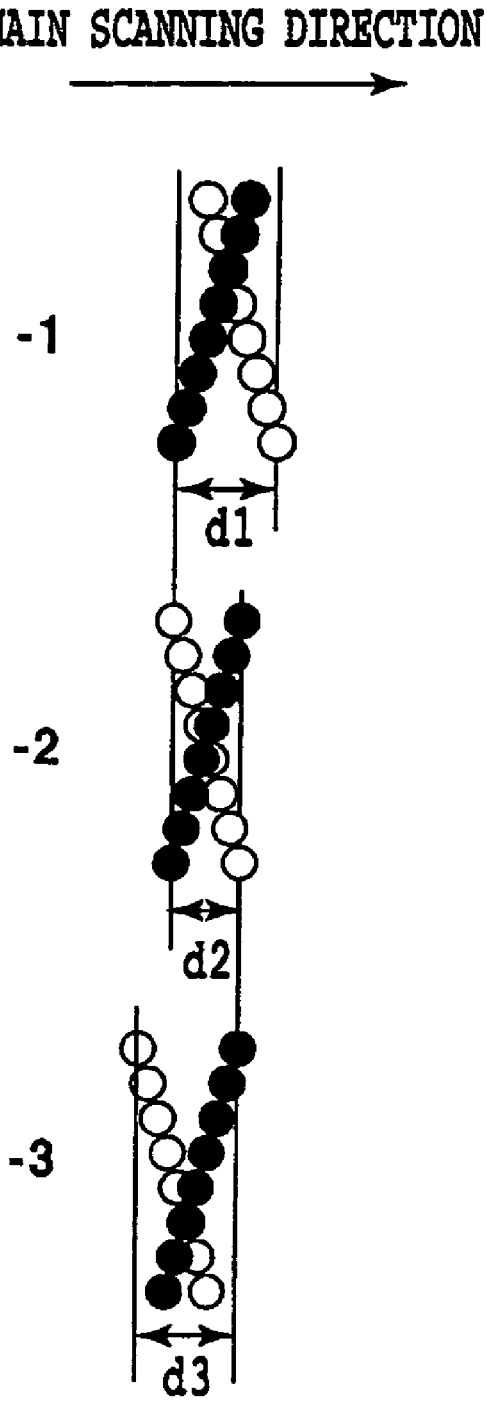
FIG. 8 is a view showing patterns of −1 to −3 pixels, out of the nine patterns shown in FIG. 7, on an enlarged scale.

The patterns of the present embodiment shown in FIGS. 14 and 15 are printed after the inclination in each discharge port row is corrected in advance. Therefore, when compared with the conventional patterns shown in FIGS. 7 and 8, a pattern superior in linearity can be relatively easily and accurately selected.

Returning to FIG. 10 again, in Step S1505, the user observes the outputted second check patterns and selects the pattern most superior in linearity of the nine patterns, that is, the pattern of +1. Then, user enters the information from the printing apparatus or the host computer or the like connected to the printing apparatus.

In the following Step S1506, the CPU stores the entered information in the EEPROM 318 in the printing apparatus. The region where the information is stored here is a region different from a region in which the data are stored in Step S1503. By this, the printing position adjusting mode has been completed.

In a case where new image data to be printed are next entered from the image input unit 303, the CPU 300 refers the three pieces of information stored in the EEPROM 318.

Then, the CPU 300 controls the head drive controlling circuit to carry out printing after setting discharging timing in each discharge port.

As described above, according to the present embodiment, printing positions among respective discharge port rows can be corrected after correcting an inclination in each discharge port raw. For example, in the case of the conventional method described by using FIGS. 7 and 8, the distance between the most distant pixels of the discharge port rows A and B is 63 μm even after adjustment.

In contrast, according to the present embodiment, even the distance between the most distant pixels can be fit in the distance of 21 μm. That is, according to the present embodiment, since dots to be formed on a printing medium by discharge of each discharge port can be placed in a more precise position, printing with higher definition and higher quality image can be obtained. In addition, since a user is not confused when selecting an adjustment value like before, a possibility that wrong information is entered is reduced.

Second Embodiment

A second embodiment of the present invention will be described below.

Figure 16:
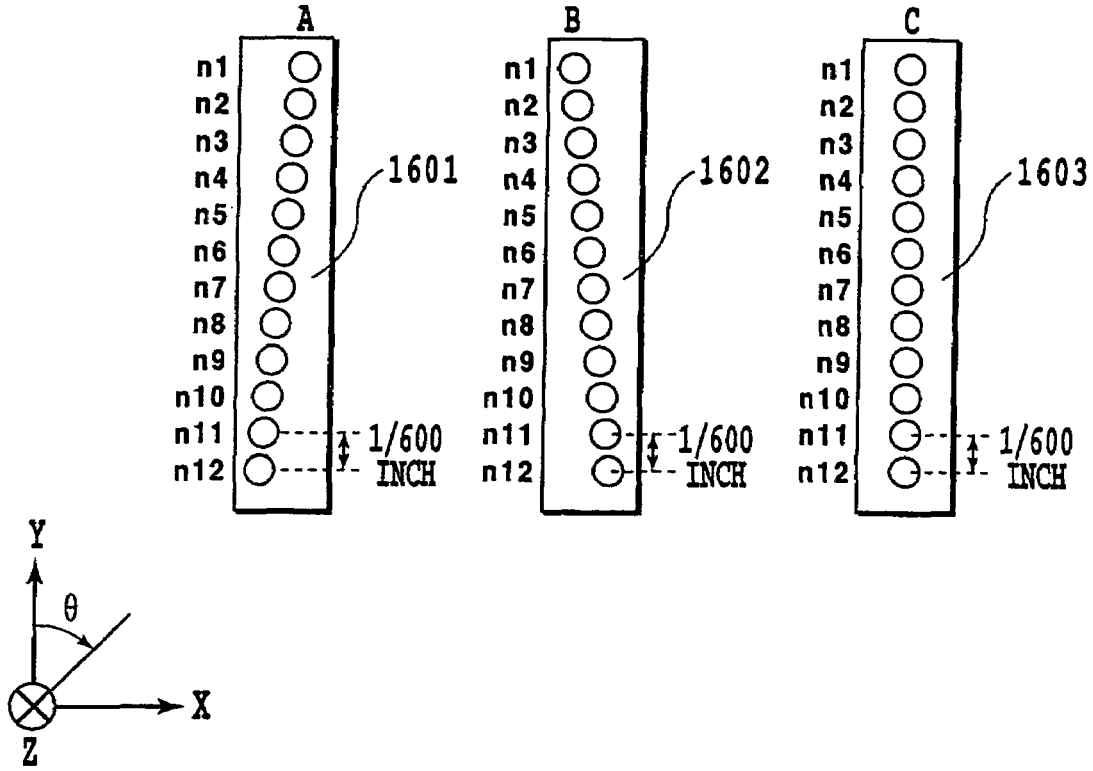
FIG. 16 is a schematic view showing an arrangement state of discharge ports of three printing heads applied in the second embodiment.

FIG. 16 is a schematic view showing an arrangement state of discharge ports of three printing heads applied in the second embodiment. In FIG. 16, reference numeral 1601 denotes a printing head for discharging black ink, reference numeral 1602 denotes a printing head for discharging cyan ink, and reference numeral 1603 denotes a printing head for discharging magenta ink. In each printing head, n1 to n12 of the discharge ports are arranged at 1/600-inch pitch, and discharge port rows A, B, and C are configured.

Each discharge port is configured to discharge an ink droplet of approximately 2 pl with a speed of approximately 20 m/sec and a frequency of 30 KHz. In addition, a carriage on which the printing heads 1601 to 1603 are mounted in parallel is movable in the X direction in FIG. 16 with a speed of approximately 25 inch/sec. With this, printing can be carried out on a printing medium with resolution of 1200 dpi in the X direction.

The printing heads 1601 to 1603 include a different inclination θ in each of the discharge port rows due to manufacturing inaccuracy. For example, in the discharge port row A of the printing head 1601, a discharge port n1 is arranged in a position shifted by approximately 63 μm in the +X direction relatively to a discharge port n12. In addition, in the discharge port row B of the printing head 1602, a discharge port n1 is arranged in a position 25 shifted by approximately 63 μm in the −X direction relatively to a discharge port n12. This distance of 63 μm corresponds to approximately 3 pixels in 1200 dpi. In the discharge port row C of the printing head 1603, an inclination is not included and a shift amount of a discharge port n1 relatively to a discharge port n12 is 0 μm. When the above-described inclination is present in the discharge port rows A and B, an image quality is deteriorated since color shift is caused between respective colors.

Figure 17:
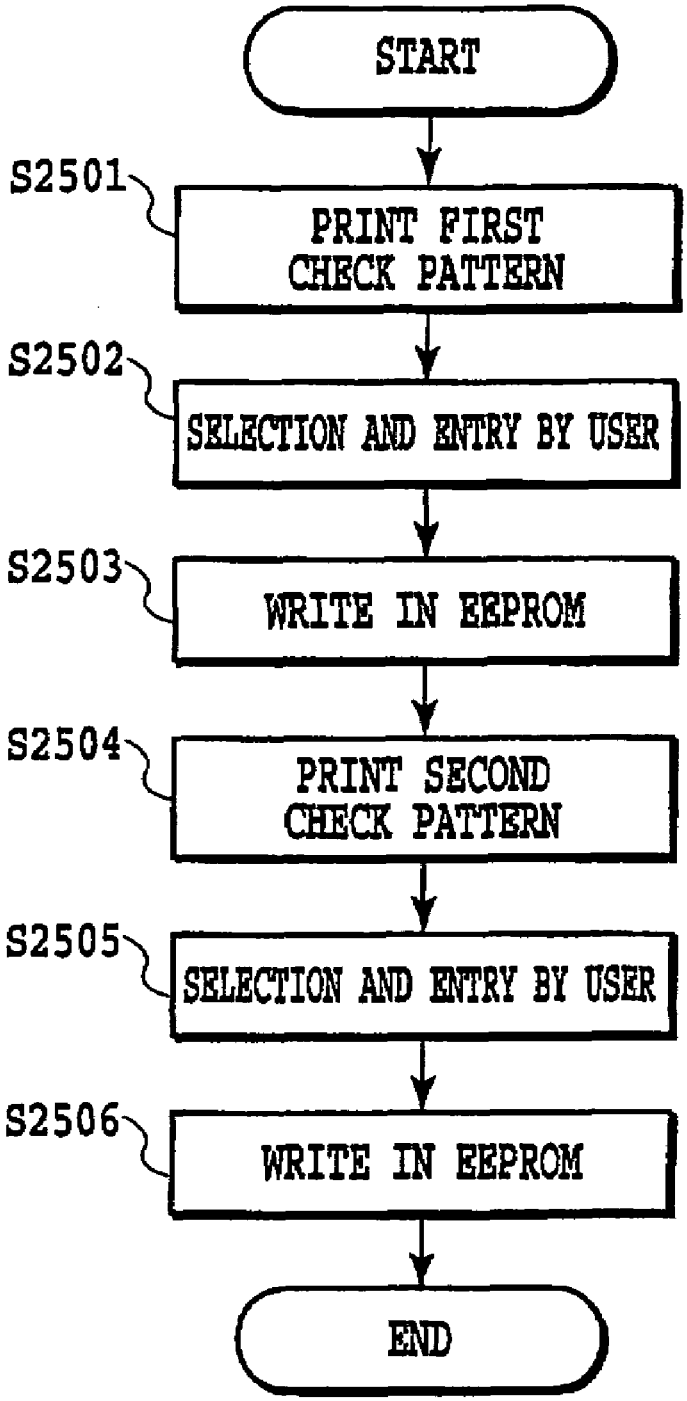
FIG. 17 is a flowchart for describing each process carried out by a CPU and a user at the time of carrying out a printing position adjusting mode in the inkjet printing apparatus of the second embodiment.

FIG. 17 is a flowchart for describing each process carried out by a CPU 300 and a user at the time of carrying out a printing position adjusting mode in the inkjet printing apparatus of the present embodiment. When printing position adjustment mode is started, the CPU 300 first prints first check patterns in Step S2501.

Figure 18:
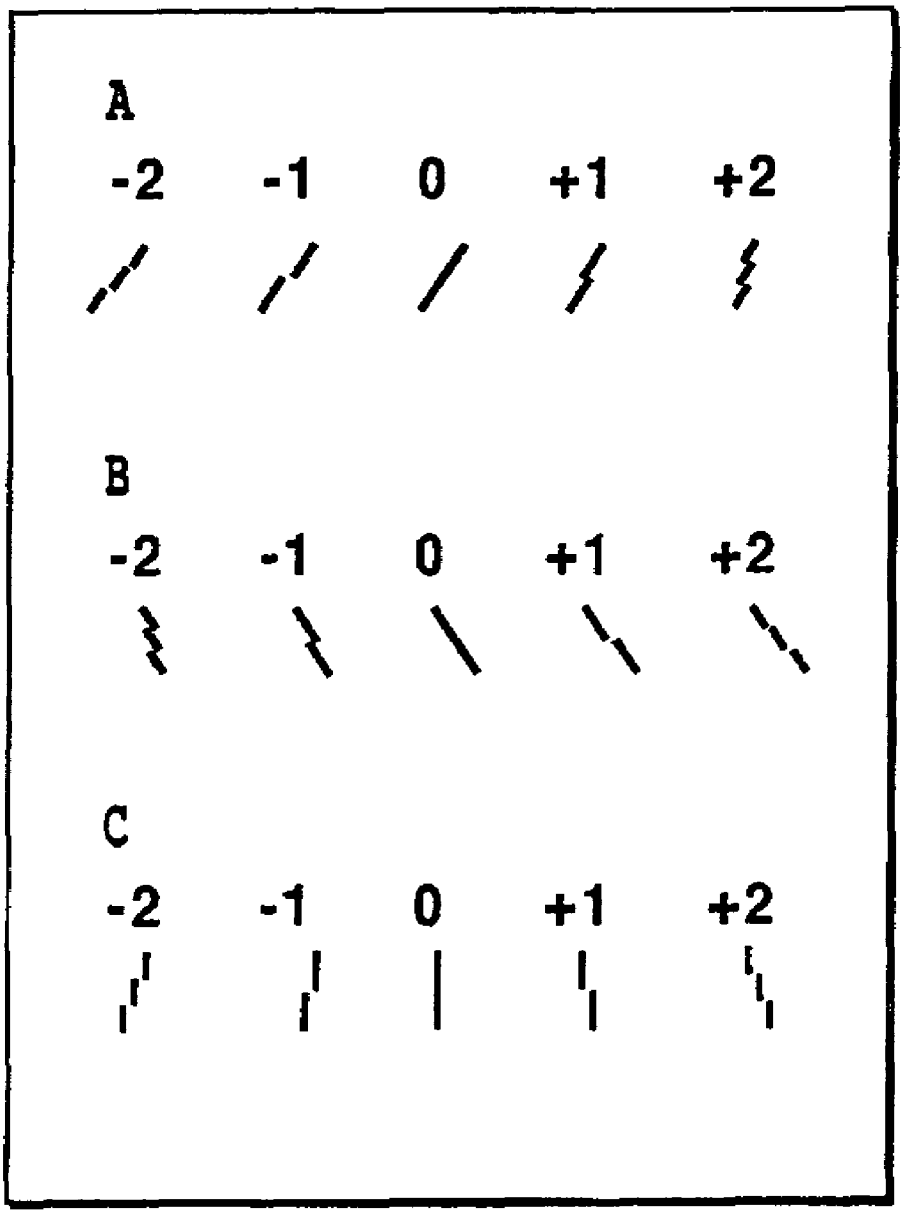
FIG. 18 is a diagram showing first check patterns for printing position adjustment applied in the second embodiment.

FIG. 18 is a view showing the first check patterns for printing position adjustment applied in the present embodiment. The first check patterns are patterns for correcting positions, which are printed by each of the discharging ports included in the discharge port rows A, B and C, in the discharge port rows. In FIG. 18, patterns A are patterns for correcting an inclination of the discharging port row A, patterns B are patterns for correcting an inclination of the discharging port row B, and patterns C are patterns for correcting an inclination of the discharging port row C.

Figure 19:
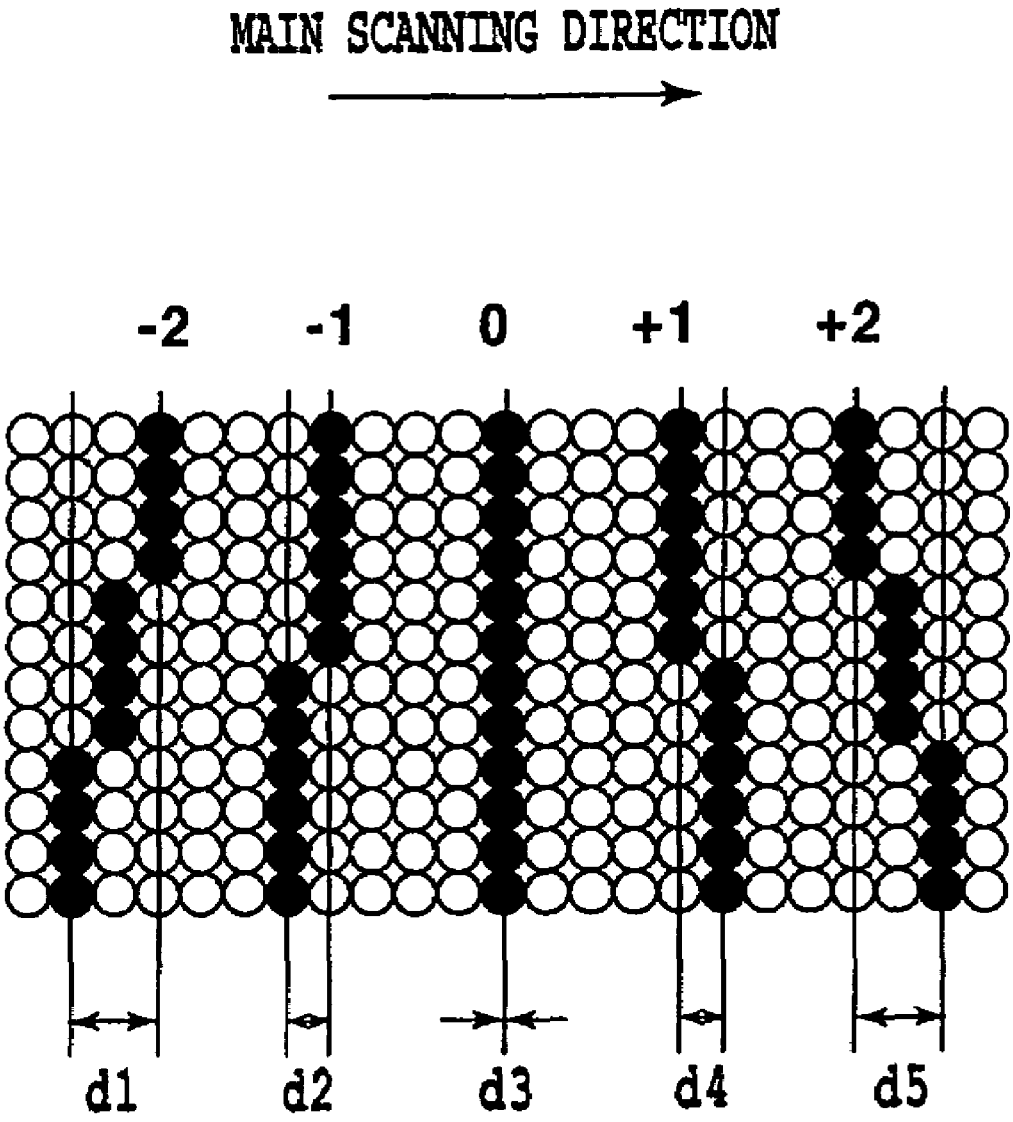
FIG. 19 is a view showing patterns C in the check patterns shown in FIG. 18 in an enlarged scale.

FIG. 19 is a view showing the patterns C on an enlarged scale. In the present embodiment, as for enlarged views of the patterns A and B, FIGS. 12A and 12B can be referred to, similarly to the first embodiment. In the present embodiment, adjustable resolving power is also 1200 dpi (approximately 21 μm), and each pixel is arranged with resolution adapted to this resolving power.

As for a group division for adjusting discharging timing, the schematic view shown in FIG. 13 can be applied, similarly to the first embodiment. By referring to FIG. 12A and 12B, in the present embodiment, a preferable image with the smallest inclination is also obtained in a state where printing is carried out at the group division and timing shown by the pattern of +2 in the discharge port row A. In addition, in the discharge port row B, a preferable image with the smallest inclination is obtained in a state where printing is carried out at the group division and timing shown by the pattern of −2.

In the discharge port row C, since an inclination is not included as shown in FIG. 19, the most preferable image is obtained in a state shown by the pattern of 0, that is, a state where timing correction is not carried out.

Returning to FIG. 17 again, the user observes the outputted first check patterns and selects a pattern with the smallest inclination for each of the patterns A to C. That is, the pattern of −2 for the patterns A, the pattern of +2 for the patterns B, and the pattern of 0 for the patterns C are selected, and the information is entered from the printing apparatus or the host computer or the like connected to the printing apparatus.

In the following Step S2503, the CUP 300 stores the three pieces of entered information in the EEPROM 318 in the printing apparatus.

Next, the CPU 300 prints second check patterns in Step S2504.

Figure 20:
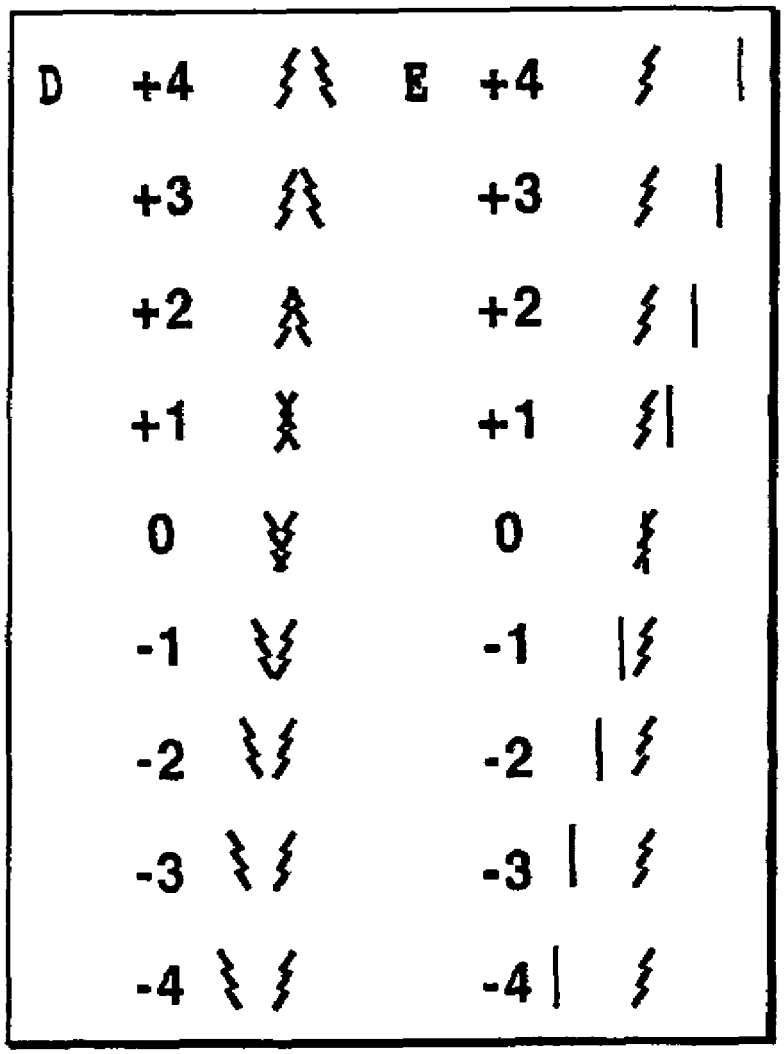
FIG. 20 is a diagram showing second check patterns for printing position adjustment applied in the second embodiment.

FIG. 20 is a view showing the second check patterns for printing position adjustment applied in the present embodiment. The second check patterns are patterns for adjusting printing positions of the discharge port rows A, B and C after correcting the inclinations with the information stored in Step S2503. Here, nine patterns that discharging timing of the discharge port row B is varied relatively to the discharge port row A in a phased manner (patterns D), and nine patterns (patterns E) that discharging timing of the discharge port row C is varied relatively to the discharge port row A in a phased manner, are printed.

In the present embodiment, as for enlarged views of the patterns of 0 to +2 of the nine patterns shown in the patterns D, FIG. 15 can be referred to, similarly to the first embodiment. In FIG. 15, black circles and white circles show dots that ink is printed by the discharge port row A and that ink is printed by the discharge port row B, respectively. The discharging timing of each discharge port row can be further adjusted on a pixel-by-pixel basis after correcting the inclination θ by the first check patterns.

By shifting discharging timing of each discharge port row in a phase manner, a distance between two dots, which are in the most distant positions in each discharge port row, is also varied in a phased manner. In the case of the present example, in the discharge port rows A and B, a preferable image with the most superior linearity is obtained in a state where printing is carried out at the timing shown by the pattern of +1.

Figure 21:
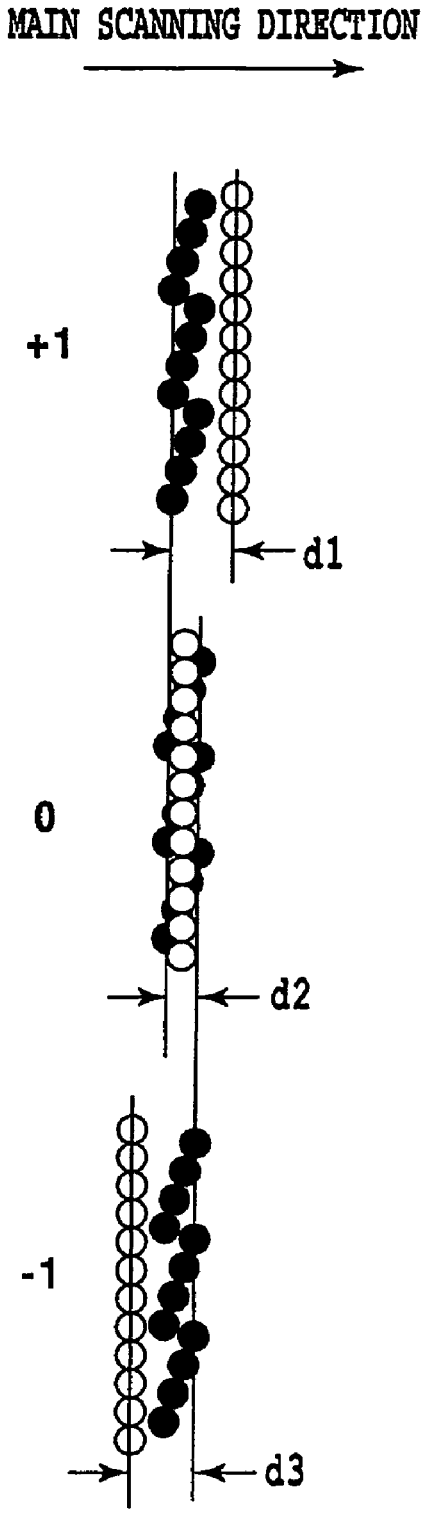
FIG. 21 is a schematic view showing patterns of −1 to +1, out of the nine patterns shown in patterns E in FIG. 20, on an enlarged scale.

FIG. 21 is a schematic view showing the patterns of −1 to +1, out of the nine patterns shown in the patterns E, on an enlarged scale. In FIG. 21, black circles and white circles show dots that ink is printed by the discharge port row A and that ink is printed by the discharge port row C, respectively. In the present example, the distance d2 which nearly equals to 10 μm in the pattern of 0 is increased to the distance d1 which nearly equals to d3 which nearly equals to 31 μm in the patterns +1 and −1. That is, in the present embodiment, a preferable image with the most superior linearity is obtained in a state where printing is carried out at the timing shown by the pattern of 0.

The second check patterns shown in FIGS. 20, 15, and 21 are printed after an inclination in each of the discharge port rows is corrected in advance. Therefore, when compared with the conventional patterns shown in FIGS. 7 and 8, patterns with superior linearity can be relatively easily and accurately selected.

Returning to FIG. 17 again, in Step S2505, the user observes the second check patterns and selects a pattern with the most superior linearity of the nine phased patterns for each of the patterns D and E. That is, the pattern of +1 for the patterns D and the pattern of 0 for the patterns E are selected, and the information is entered from the printing apparatus or the host computer or the like connected to the printing apparatus.

In the following Step S2506, the CPU 300 stores the entered information in the EEPROM 318 in the printing apparatus. The region where the data are stored here is a region different from the region where the data are stored in Step S2503. By this, the printing position adjusting mode has been completed.

In a case where new image data to be printed are next entered from the image input unit 303, the CPU 300 refers to the five pieces of information stored in the EEPROM 318. Then, it controls the head drive controlling circuit to carry out printing after discharging timing at each discharge port is set.

According to the present embodiment as described above, printing positions among respective discharge port rows can be corrected after inclinations in each discharge port row on different printing heads are corrected. By this, when compared with the conventional method, printing positions of each dot can be adjusted with higher definition. In addition, similar to the first embodiment, there is no case where a user is confused when selecting an adjusting value, thereby a possibility of wrong information to be entered is reduced.

Third Embodiment

A third embodiment of the present invention will be described below.

Figure 22:
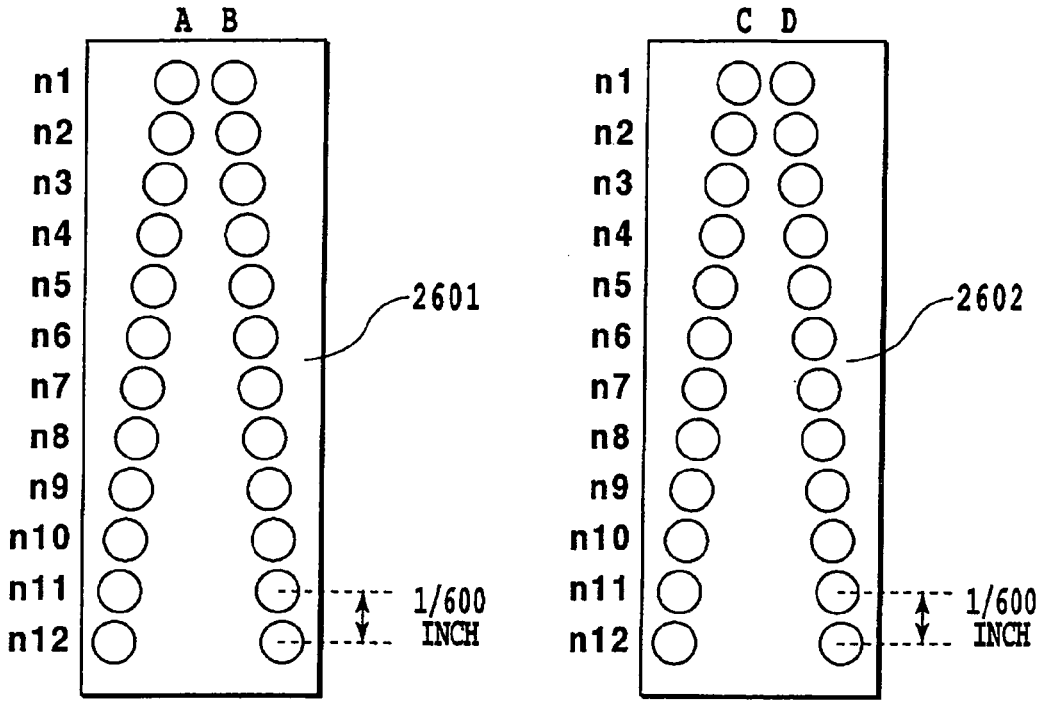
FIG. 22 is a view showing two printing heads applied in a third embodiment.
Figure 22:
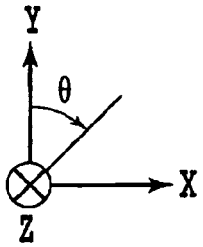

FIG. 22 is a view showing two printing heads applied in the present embodiment. The present embodiment has a configuration that two printing heads, in which two discharge port rows are respectively arranged, are mounted on a carriage so as to carry out printing. In FIG. 22, reference numeral 2601 denotes a printing head in which a discharge port row A for discharging black ink and a discharge port row B for discharging cyan ink are arranged. Reference numeral 2602 denotes a sprinting head in which a discharge port row C for discharging magenta ink and a discharge port row D for discharging yellow ink are arranged. In each discharge port row, n1 to n12 of the discharge ports are arranged at 1/600-inch pitch.

Each discharge port is configured to discharge a droplet of approximately 2 pl at a speed of approximately 20 m/sec and a frequency of 30 KHz. In addition a carriage on which the printing heads 2601 and 2602 are mounted in parallel is movable in the X direction in FIG. 22 at a speed of approximately 25 inch/sec. With this, printing can be carried out on a printing medium in the X direction at resolution of 1200 dpi.

The printing heads 2601 and 2602 include a different inclination θ in each of the discharge port rows due to manufacturing inaccuracy. For example, in the discharge port row A of the printing head 2601, a discharge port n1 is arranged in a position shifted in the +X direction by approximately 63 μm relatively to a discharge port n12. In addition, in the discharge port row B, a discharge port n1 is arrange in a position shifted in the −X direction by approximately 42 μm relatively to a discharge port n12. Moreover, in the discharge port row C, a discharge port n1 is arranged in a position shifted in the +X direction by 42 μm relatively to a discharge port n12, and in the discharge port row D, a discharge port n1 is arranged in a position shifted in the −X direction by approximately 63 μm relatively to a discharge port n12. These distances of 63 μm and 42 μm correspond to approximately three and two pixels, respectively, in 1200 dpi. When the above-described inclination is included in the two printing heads, an image quality is deteriorated because color shift is caused between respective colors.

Figure 23:
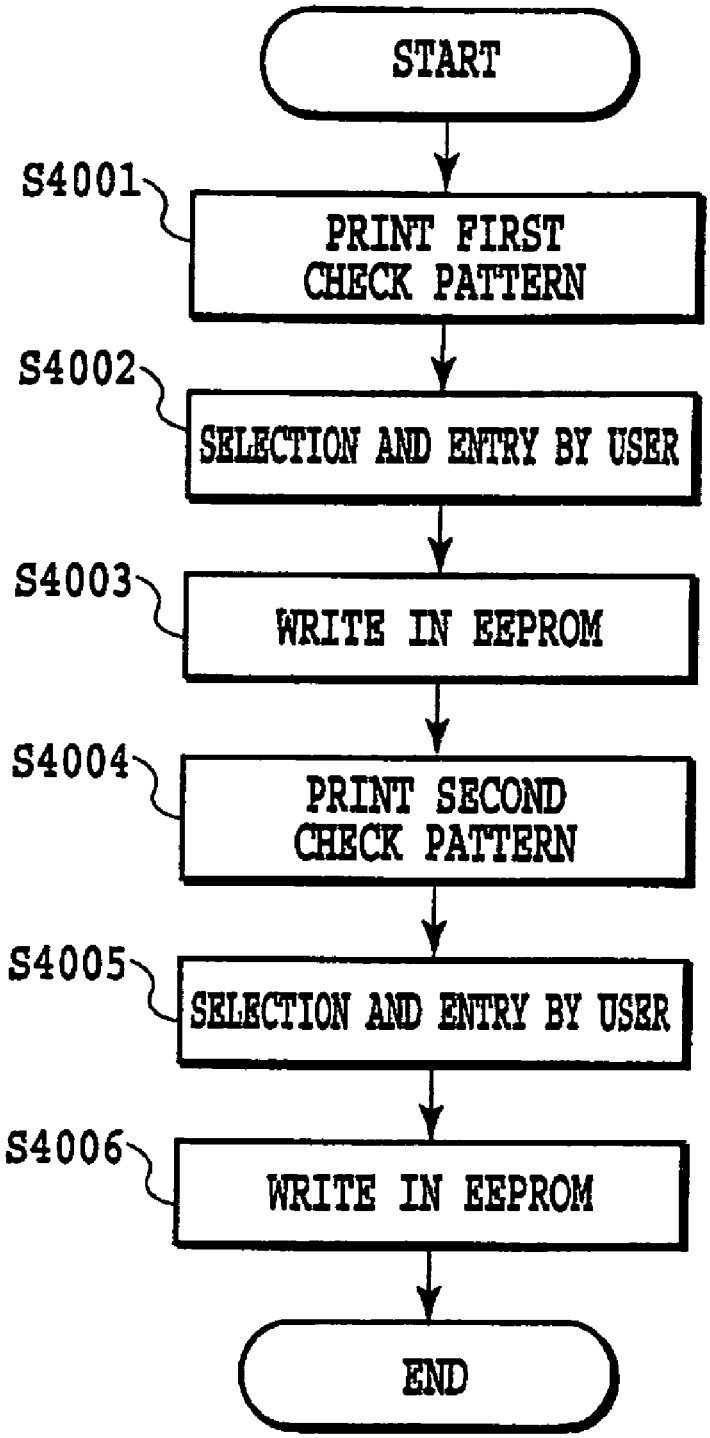
FIG. 23 is a flowchart for describing each process carried out by a CPU and a user at the time of carrying out printing position adjustment in the inkjet printing apparatus of the third embodiment.

FIG. 23 is a flowchart for describing each process carried out by a CPU 300 and a user at the time of carrying out a printing position adjusting mode in the inkjet printing apparatus of the present embodiment. When the printing position adjusting mode is started, the CPU 300 first prints first check patterns in Step S4001.

Figure 24:
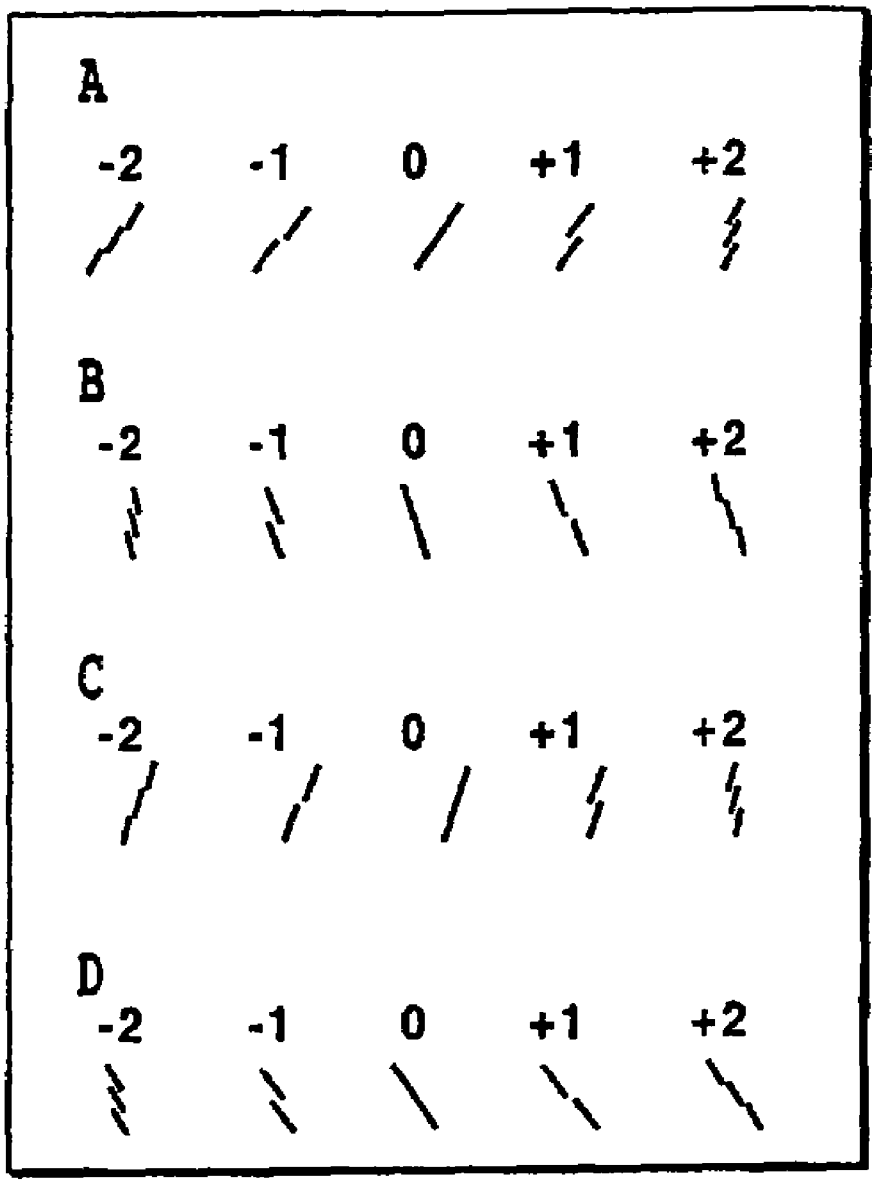
FIG. 24 is a diagram showing first check patterns for printing position adjustment applied in the third embodiment.

FIG. 24 is a view showing the first check patterns for printing position adjustment applied in the present embodiment. The first check patterns are patterns for correcting positions, which are printed by discharge ports included in discharge port rows A, B, C, and D for every row. In FIG. 24, the patterns A are patterns for correcting an inclination of the discharge port row A, the patterns B are patterns for correcting an inclination of the discharge port row B, the patterns C are patterns for correcting an inclination of the discharge port row C, and the patterns D are patterns for correcting an inclination of the discharge port row D.

Figure 25A:
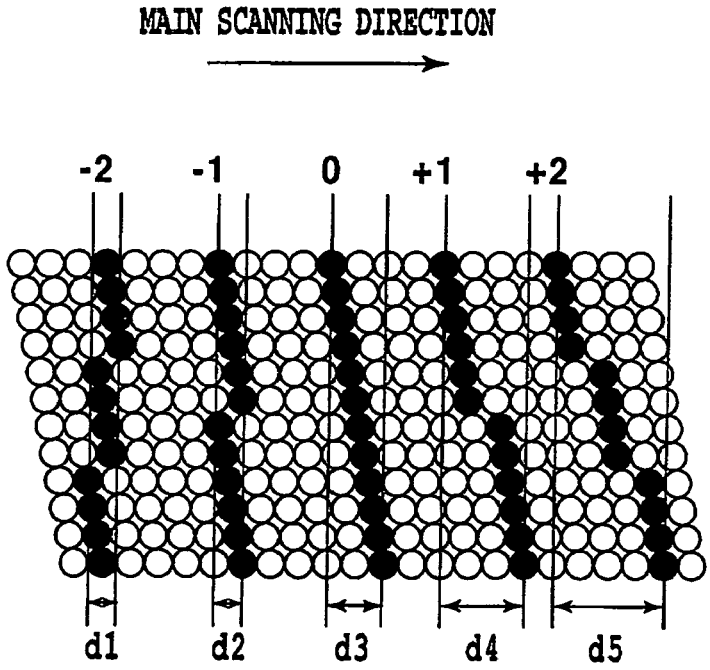
FIGS. 25A and 25B are views showing patterns B and C in FIG. 24 on an enlarged scale.
Figure 25B:
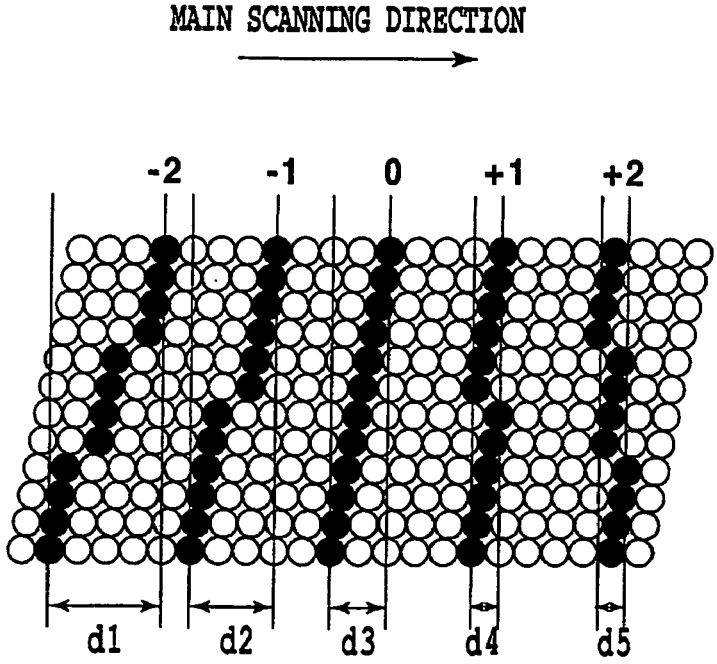

FIGS. 25A and 25B are views showing the patterns B and C on an enlarged scale. In the present embodiment, as for enlarged views of the patterns A and D, FIGS. 12A and 12B can be referred to similarly to the first embodiment. In the present embodiment, adjustable resolving power is also 1200 dpi (approximately 21 μm), and each pixel is arranged with resolution adapted to this resolving power.

As for a group division for adjusting discharging timing, the schematic view shown in FIG. 13 can be applied, similarly to the first embodiment. Referring to FIGS. 12A and 12B, in the present embodiment, the pattern of +2 in the discharge port row A and the pattern of −2 in the discharge port row D become patterns with the smallest inclination and closest to straight lines. In contrast, in the discharge port rows B and C, referring to FIGS. 25A and 25B, the pattern of −1 in the discharge port row B and the pattern of +1 in the discharge port row C become patterns with the smallest inclination and closest to straight lines.

Returning to FIG. 23 again, in Step S4002, the user observes the outputted first check patterns and selects a pattern with the smallest inclination for each of the patterns A to D. That is, the pattern of +2 for the patterns A, the pattern of −1 for the patterns B, the pattern of +1 for the patterns C, and the pattern of −2 for the patterns D are respectively selected. Then, the selected information is entered from the printing apparatus or the host computer or the like connected to the printing apparatus.

In the following Step S4003, the CPU 300 stores the four pieces of entered information in the EEPROM 318.

Next, the CPU 300 prints second check patterns in Step S4004.

Figure 26A:
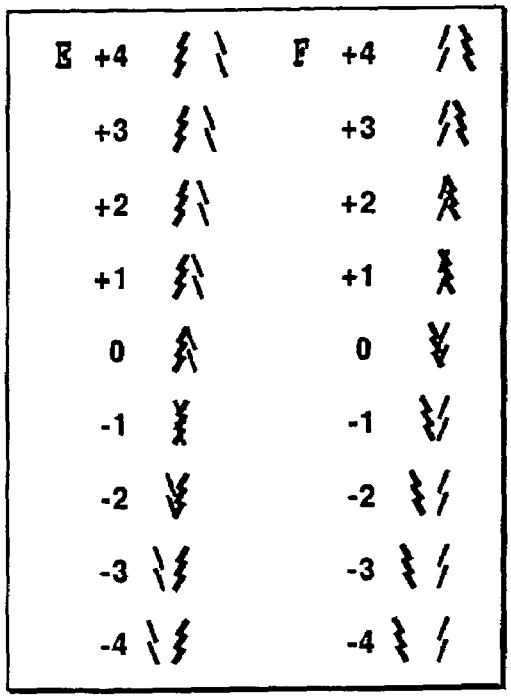
FIGS. 26A and 26B are diagrams showing second check patterns for printing position adjustment applied in the third embodiment.
Figure 26B:
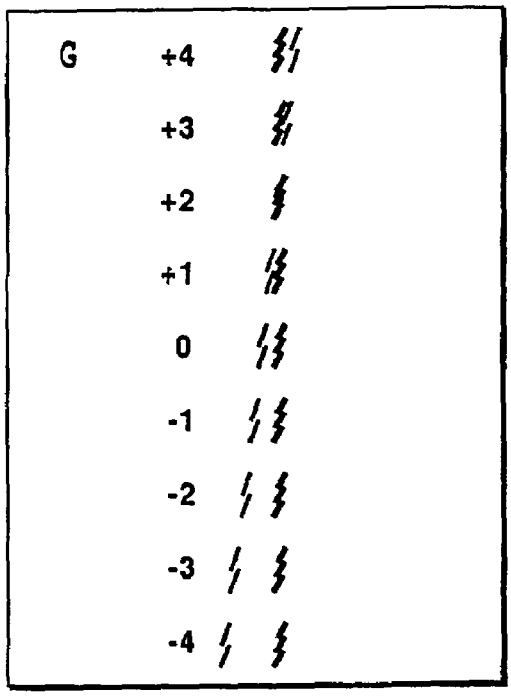

FIGS. 26A and 26B are views showing the second check patterns for printing position adjustment applied in the present embodiment. The second check patterns are patterns for correcting printing positions between respective discharge port rows after correcting inclinations by the information stored in Step S4003. Here, nine patterns that discharging timing of the discharge port row B is shifted relatively to the discharge port row A in a phased manner (patterns E), nine patterns that discharging timing of the discharge port row D is shifted relatively to the discharge port row C in a phased manner (patterns F), and nine patterns that discharging timing of the discharge port row C is shifted relatively to the discharge port row A in a phased manner (patterns G), are printed in two pages.

Figure 27:
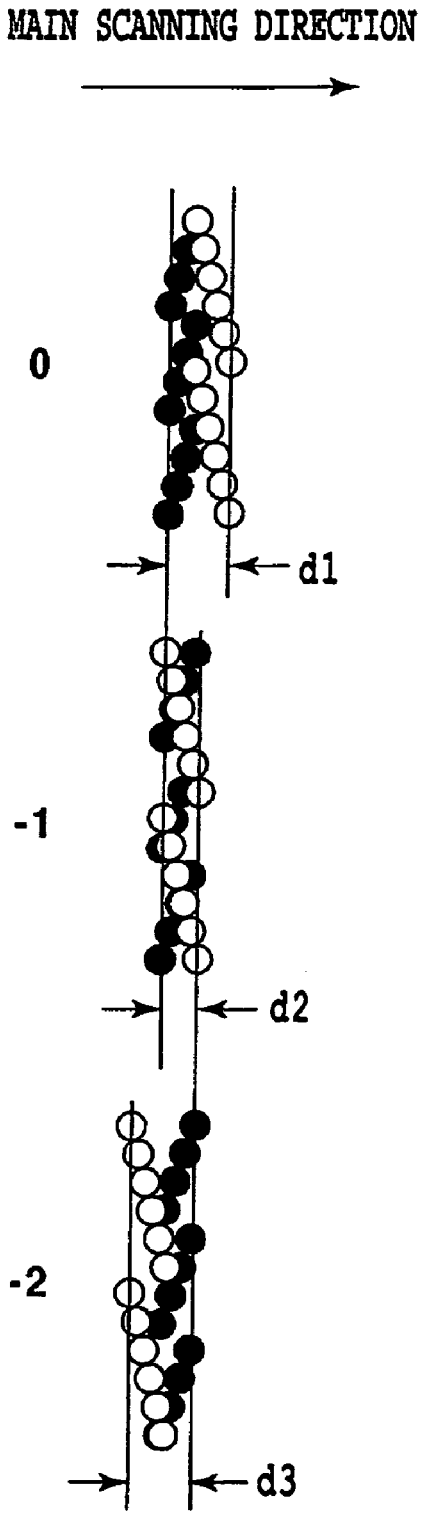
FIG. 27 is a schematic view showing patterns of 0 to −2, out of the nine patterns shown in patterns E in FIG. 26A, on an enlarged scale.

FIG. 27 is a schematic view showing the patterns of −2 to 0, out of the nine patterns shown in the patterns E, on an enlarged scale. In FIG. 27, black circles and white circles show dots that ink is printed by the discharge port row A and that ink is printed by the discharge port row B, respectively. The discharging timing of each port row can be further adjusted on a pixel-by-pixel basis after correcting an inclination θ by the first check patterns.

In this manner, by shifting the discharging timing at each discharge port row in a phased manner, a distance between two pixels, which are in the most distant positions in each discharge port row, is also varied in a phased manner. In the present example, the distance d1 which nearly equals to 42 μm in the pattern of 0 is reduced to the distance d2 which nearly equals to 21 μm in the pattern of −1, and increases again to the distance d3 which nearly equals to 42 μm in the pattern of −2. That is, in the present example, a preferable image with the most superior linearity is obtained in a state where printing is carried out at the timing shown by the pattern of −1.

Figure 28:
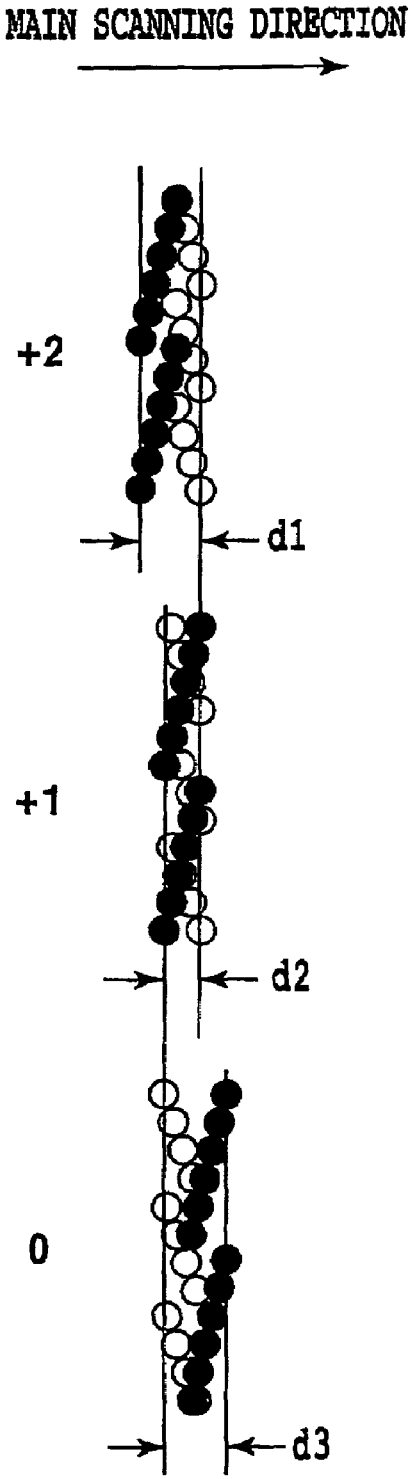
FIG. 28 is a schematic view showing patterns of 0 to +2, out of the nine patterns shown in patterns F, on an enlarged scale.

FIG. 28 is a schematic view showing the patterns of 0 to +2, out of the nine patterns shown in the patterns F, on an enlarged scale. In the figure, black circles and white circles show dots that ink is printed by the discharge port row C and that the ink is printed by the discharge port row D, respectively. In the present example, the distance d3 which nearly equals to 42 μm in the pattern of 0 is reduced to the distance d2 which nearly equals to 21 μm in the pattern of +1, and increases again to the distance d3 which nearly equals to 42 μm in the pattern of +2. That is, in the present embodiment, a preferable image with the most superior linearity is obtained in a state where printing is carried out at the timing shown by the pattern of +1.

Figure 29:
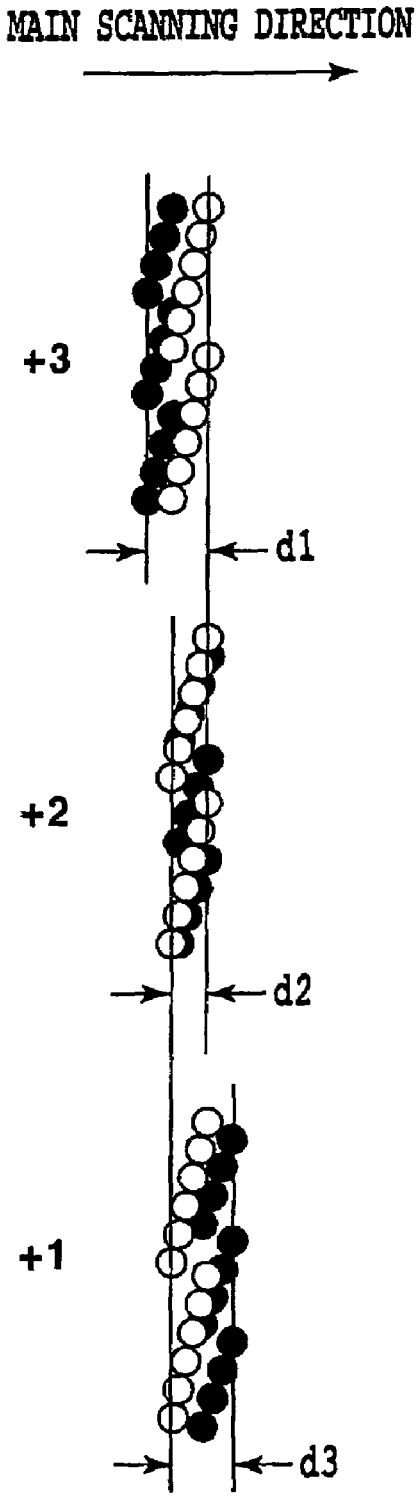
FIG. 29 is a schematic view showing patterns of +1 to +3, out of the nine patterns shown in patterns G, in an enlarged scale.

FIG. 29 is a schematic view showing the patterns of +1 to +3, out of the nine patterns shown in the patterns G, on an enlarged scale. In FIG. 29 black circles and white circles show dots that ink is printed by the discharge port row A and that ink is printed by the discharge port row C, respectively. In the present example, the distance which is 63 μm in the pattern of 0 is reduced in a phased manner to the distance d3 which nearly equals to 42 μm in the pattern of +1, and reduced to the distance d2 which nearly equals to 21 μm in the pattern of +2, and increases again to the distance d1 which nearly equals to 42 μm in the pattern of +3. That is, in the present embodiment, a preferable image with the most superior linearity is obtained in a state where printing is carried out at the timing shown by the pattern of +2.

Returning to FIG. 23 again, in Step S4005, the user observes the second check patterns and selects a pattern with the most superior linearity of the nine phased patterns for each of the patterns E, F, and G. That is, the pattern of −1 for the patterns E, the pattern of +1 for the patterns F, and the pattern of +2 for the patterns G, are selected, and the information is entered from the printing apparatus or the host computer or the like connected to the printing apparatus.

In the following Step S4006, the CPU 300 stores the entered information in the EEPROM 318 in the printing apparatus. The region where the data are stored here is a region different from the region where the data are stored: in Step S4003. By this, the printing position adjusting mode of the present embodiment has been completed.

It should be noted that in the above-described steps, only the information of alignment to three sets of the four discharge port rows A to D is entered. For example, the alignment of the discharge port rows A and D and the alignment of the discharge port rows B and C are not actually carried out. However, printing positions of all combinations of the discharge port rows can be relatively corrected by using the three pieces of information entered above. For example, there has been stored that the discharge port row C needs correction by +2 relatively to the discharge port row A, and the discharge port row D needs correction by +1 relatively to the discharge port row C. Therefore, the discharge port row D needs correction by (+2)+(+1)=+3 relatively to the discharge port row A.

In addition, the second check patterns for alignment of the printing positions of four kinds of the discharging port rows are not limited to the patterns shown in FIGS. 25 and 26.

Figure 30:
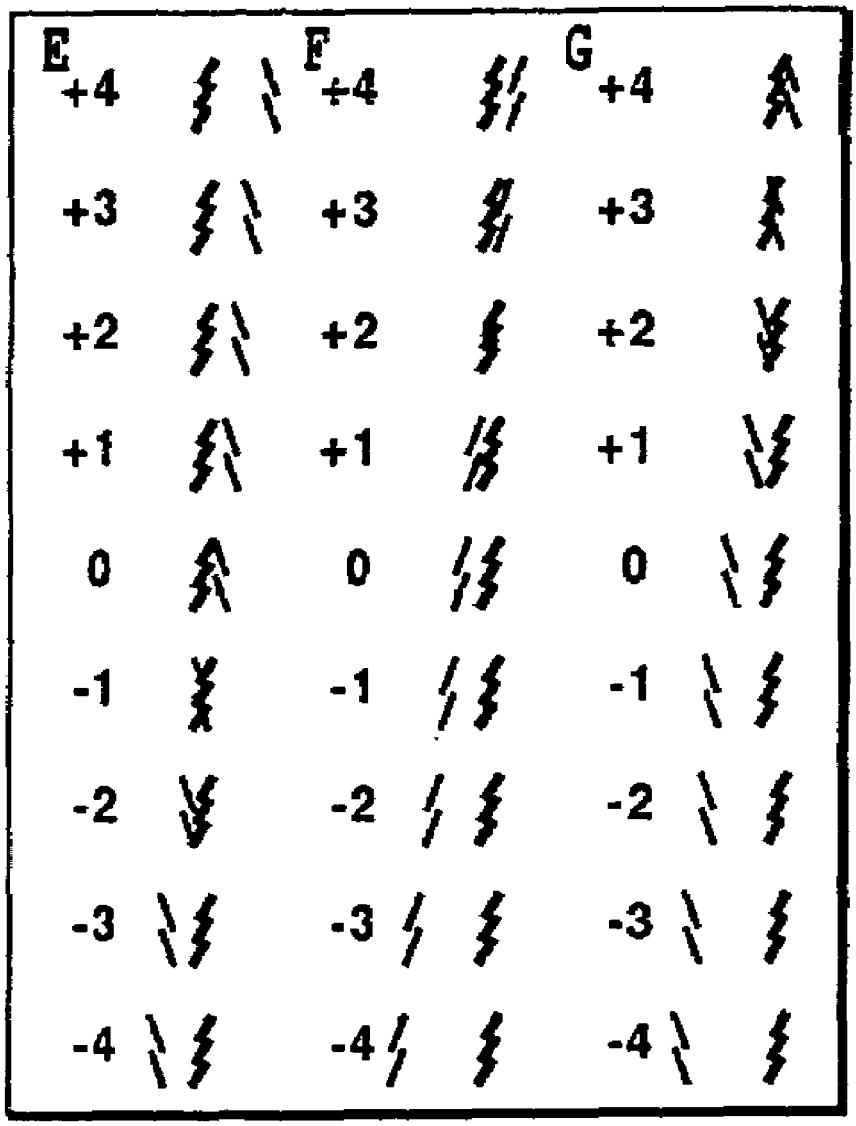
FIG. 30 is a diagram showing another example being applicable as the second check patterns of the third embodiment.

FIG. 30 is a view showing another example applicable as the second check patterns of the present embodiment. Here, nine patterns that discharging timing of the discharge port rows B, C and D are shifted in a phased manner relatively to the discharge port row A are respectively printed as the patterns E, F and G in the same page. Enlarged views of the patterns E and F are similar to those in FIGS. 27 and 29.

Figure 31:
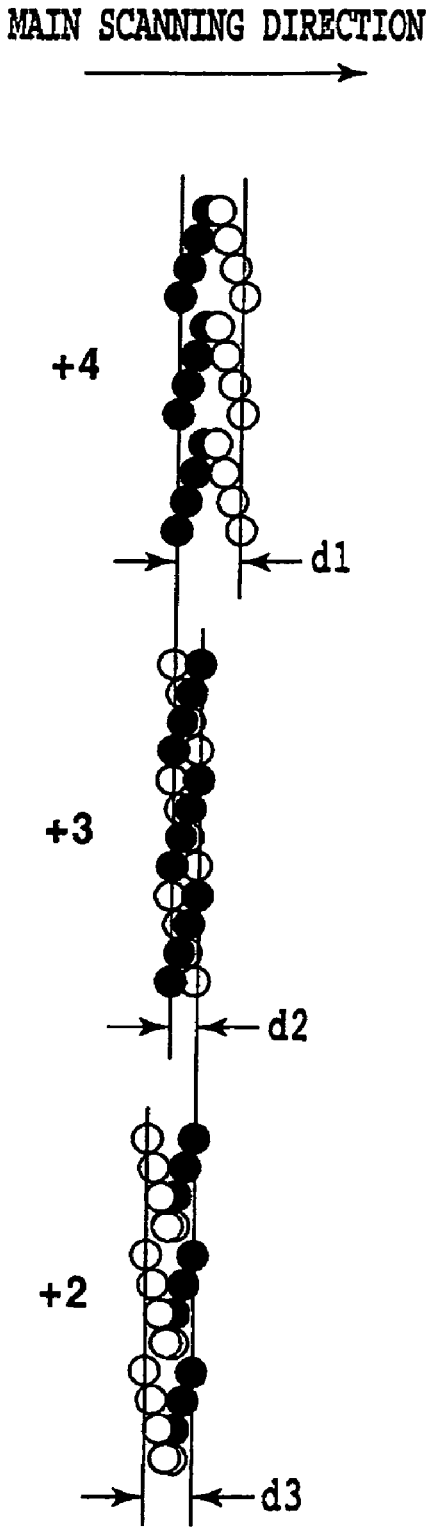
FIG. 31 is a schematic view showing patterns of +2 to +4, out of the nine patterns shown in patterns G shown in FIG. 30, on an enlarged scale.

FIG. 31 is a schematic view showing the patterns of +2 to +4, out of the nine patterns shown in the patterns G in the second check patterns of this example, on an enlarged scale. In FIG. 31, black circles and white circles show dots that ink is printed by the discharge port row A and that ink is printed by the discharge port row D, respectively. In this example, the distance d3 which nearly equals to 42 μm in the pattern of +2 is reduced to the distance d2 which nearly equals to 21 μm in the pattern of +3, and increases to the distance d1 which nearly equals to 42 μm in the pattern of +4. That is, in this example, in the discharge port row D, a preferable image with the most superior linearity is obtained in a state where printing is carried out at the timing of +3 relatively to the discharge port row A. This value equals to the correction value calculated by using FIGS. 25 and 26.

In a case where new image data to be printed are next entered from the image input unit 303, the CPU 300 refers to the seven pieces of information stored in the EEPROM 318. Then, it controls the head drive controlling circuit to carry out printing after setting timing at each discharge port.

As described above according to the present embodiment, in an inkjet printing apparatus using a plurality of printing heads having a plurality of discharge port rows, printing positions among respective discharge port rows can be corrected after correcting an inclination in each discharge port row. By this, when compared with a conventional method, printing positions of dots can be adjusted with higher definition. In addition, similar to the above-described embodiment, there is no case where a user is confused when selecting an adjustment value; thereby a possibility of wrong information to be entered is reduced.

In the above-described three embodiments, for simplicity, the description has been given by using the configuration in which twelve discharge ports are arranged in each discharge port row. However, effects of the present invention and the above-described embodiments can be similarly obtained even in a configuration in which more number of discharge ports and ink colors are prepared. For example, the effects of the present invention are valid even in a printing apparatus, which uses inks such as blue and red in addition to the four colors of cyan, magenta, yellow, and black described in the third embodiment, and which includes more discharge port rows and printing heads. In this case, more number of discharge ports in a group in the first check patterns or more number of divisions can be set.

In addition, an ink amount discharged from each discharge port, a discharge frequency, printing resolution and the like are also not limited to the values shown in the above-described embodiments. An ink droplet larger or smaller than 2 pl can be also applied to the present invention. In addition, an amount of discharging ink can be varied for each discharge port row.

Figure 32:
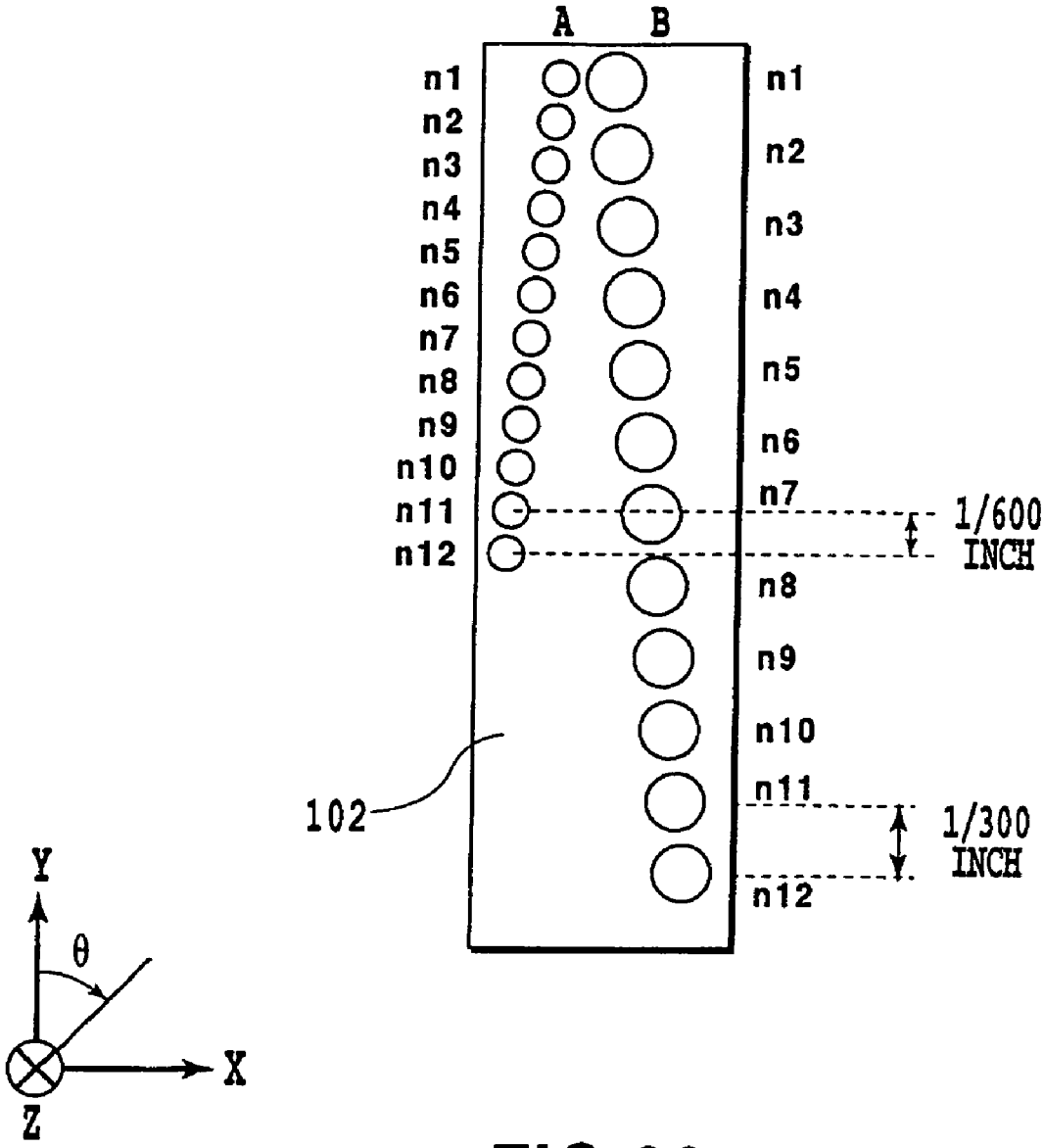
FIG. 32 is a schematic view of a printing head in which two discharge port rows, having different arrangement pitches and being applicable to the present invention, are arranged.

FIG. 32 shows a printing head in which two discharge port rows having different arrangement pitches are arranged. In FIG. 32, each discharge port is arranged at 1/600-inch intervals in a discharge port row A, while each discharge port is arranged at 1/300 inch-intervals in a discharge port row B. Even in such a case, in each discharge port row, by dividing n1 to n12 of the discharge ports into groups with the method described in FIG. 13, an inclination in each discharge port row can be corrected. Moreover, as for alignment between each discharge port row, the discharge ports n1 to n12 in the discharge port row A may be aligned to the vicinity of the discharge ports n1 to n6 in the discharge port row B.

Figure 33:
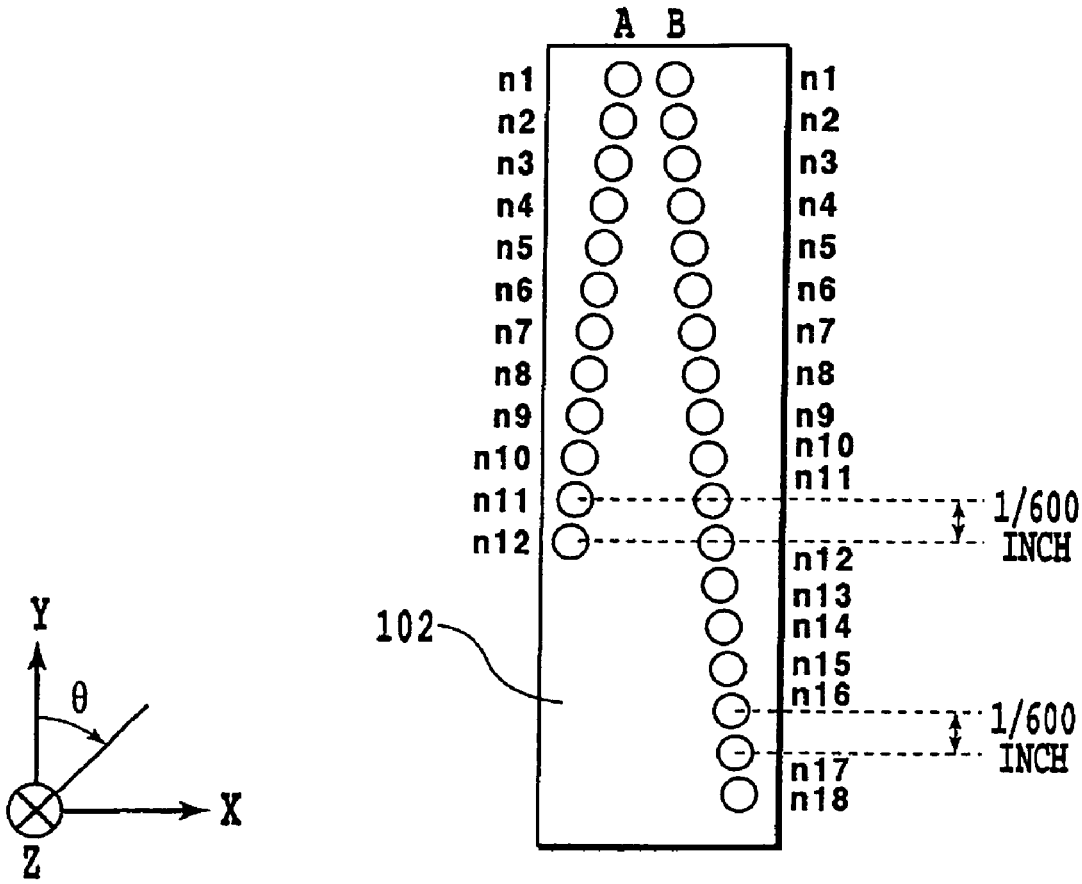
FIG. 33 is a schematic view of a printing head in which two discharge port rows, which have an arrangement pitch being applicable to the present invention and which have different number of discharge ports, are arranged.

FIG. 33 shows a printing head in which two discharge port rows having different number of discharge ports are arranged. In FIG. 33, twelve discharge ports are arranged at 1/600-inch intervals in a discharge port row A, while eighteen discharge ports are arranged in a discharge port row B. Even in such a case, in the discharge port row B, by dividing n1 to n18 of the discharge ports into two groups of n1 to n9 and n1 to n18 of the discharge ports, or into three groups of n1 to n6, n7 to n12, and n13 to n18 of the discharge ports, an inclination in the discharge port row can be corrected similarly to the above-described embodiments.

Figure 34:
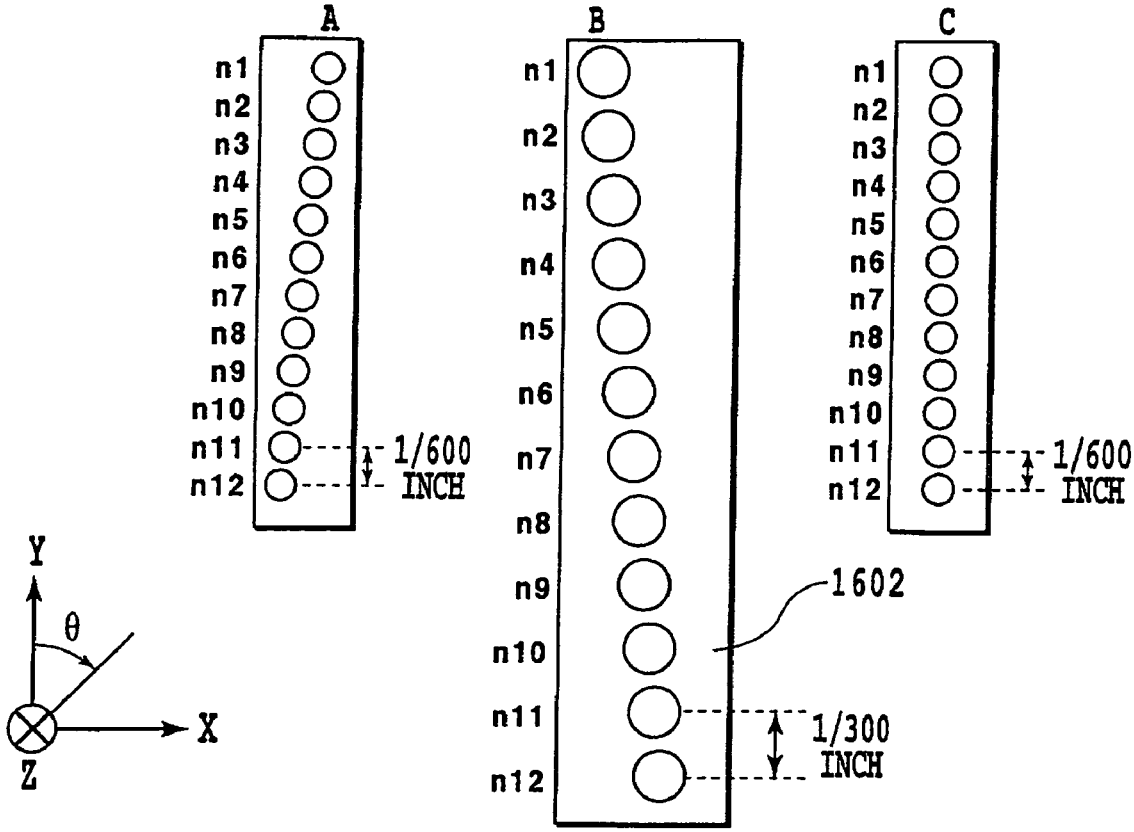
FIG. 34 is a schematic view of three printing heads in which discharge port rows, which have different arrangement pitched being applicable to the present invention, are respectively arranged.

FIG. 34 shows three printing heads in which a discharge port row having a different arrangement pitch is each arranged. In FIG. 34, each discharge port is arranged at 1/600-inch intervals in discharge port rows A and C, while each discharge port is arranged at 1/300-inch intervals in a discharge port row B. Even in such a case, in each discharge port row, by dividing n1 to n12 of the discharge ports into groups with the method described in FIG. 13, an inclination in each discharge port row can be corrected. In addition, as for alignment between each discharge row, the discharge ports n1 to n12 in the discharge port row A and the discharge ports n1 to n12 in the discharge port row C may be configured to be aligned to the vicinity of the discharge ports n1 to n6 in the discharge port row B.

Figure 35:
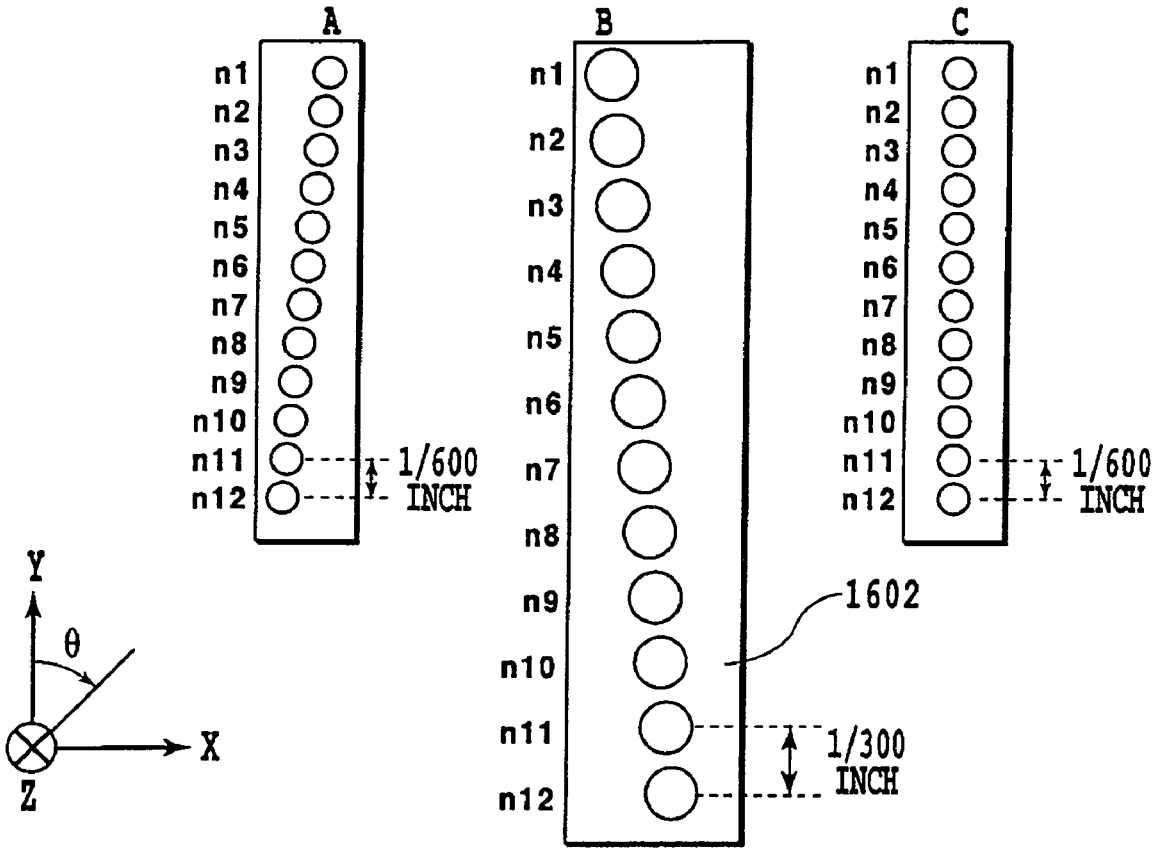
FIG. 35 is a schematic view of three printing heads in which discharge port rows, which have an arrangement pitches being applicable to the present invention and which have different number of discharge ports, are respectively arranged.

FIG. 35 shows three printing heads in which a discharge port row having different number of discharge ports is each arranged. In FIG. 35, twelve discharge ports are arranged at 1/600-inch intervals in discharge port rows A and C, while eighteen discharge ports are arranged in a discharge port row B. Even in such a case, in the discharge port row B, by dividing the discharge ports n1 to n18 into two groups of n1 to n9 and n10 to n18 of the discharge ports, or into three groups of n1 to n6, n7 to n12, and n13 to n18 of the discharge ports, an inclination in the discharge port row can be corrected similarly to the above-described embodiments.

Figure 36:
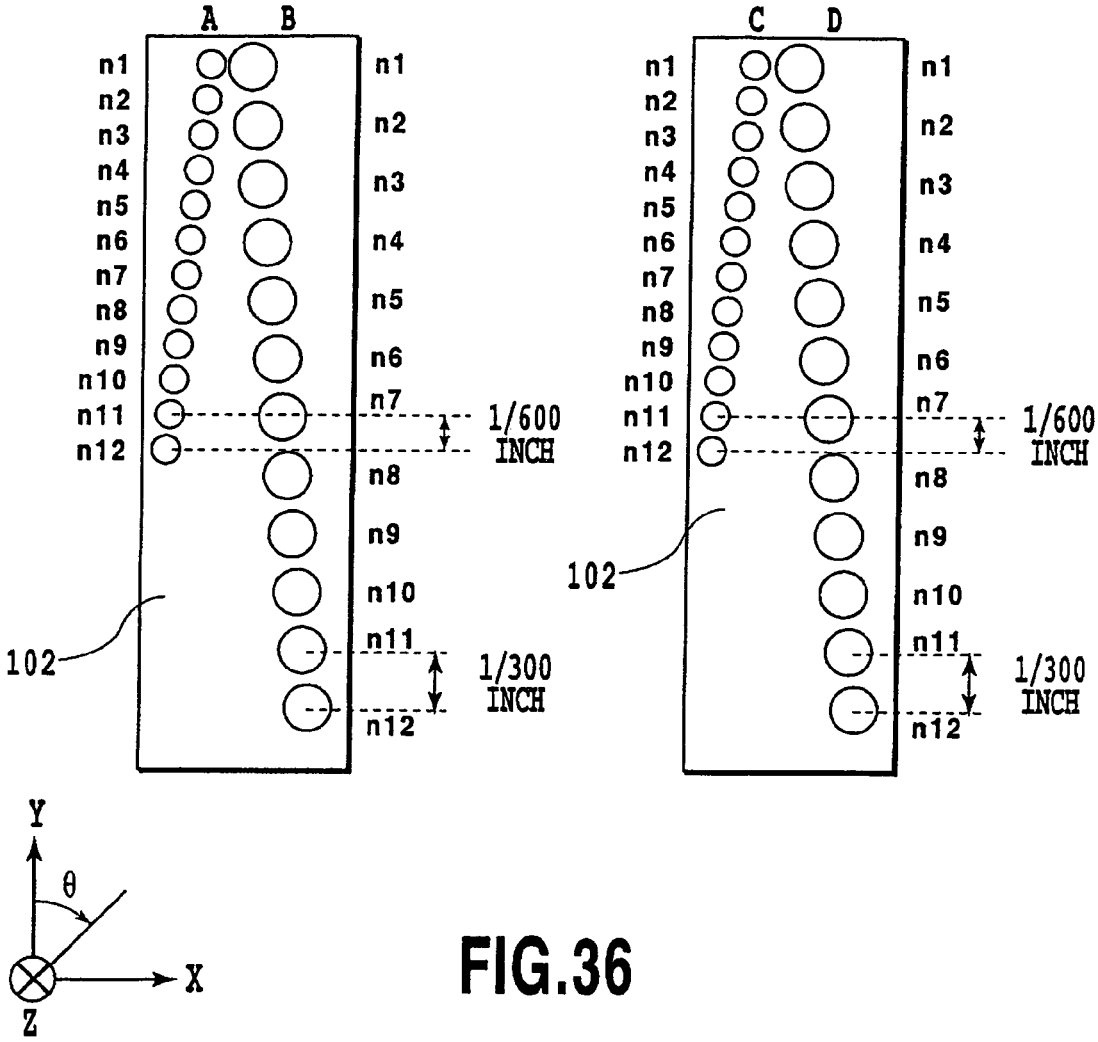
FIG. 36 is a schematic view of two printing heads in which two discharge port rows, having different arrangement pitches and being applicable to the present invention, are respectively arranged.

FIG. 36 shows two printing heads in which two discharge port rows having different arrangement pitches are respectively arranged. In FIG. 36, each discharge port is arrange at 1/600-inch intervals in discharge port rows A and C, while each discharge port is arrange at 1/300-inch intervals in discharge port rows B and D. Even in such a case, in each discharge port row, by dividing n1 to n12 of the discharge ports into groups with the method described in FIG. 13, an inclination in each of the discharge port rows can be corrected. In addition, as for alignment between each discharge row, the discharge ports n1 to n12 in the discharge port rows A and C may be configured to be aligned to the vicinity of the discharge ports in the discharge port rows B and D, respectively.

Figure 37:
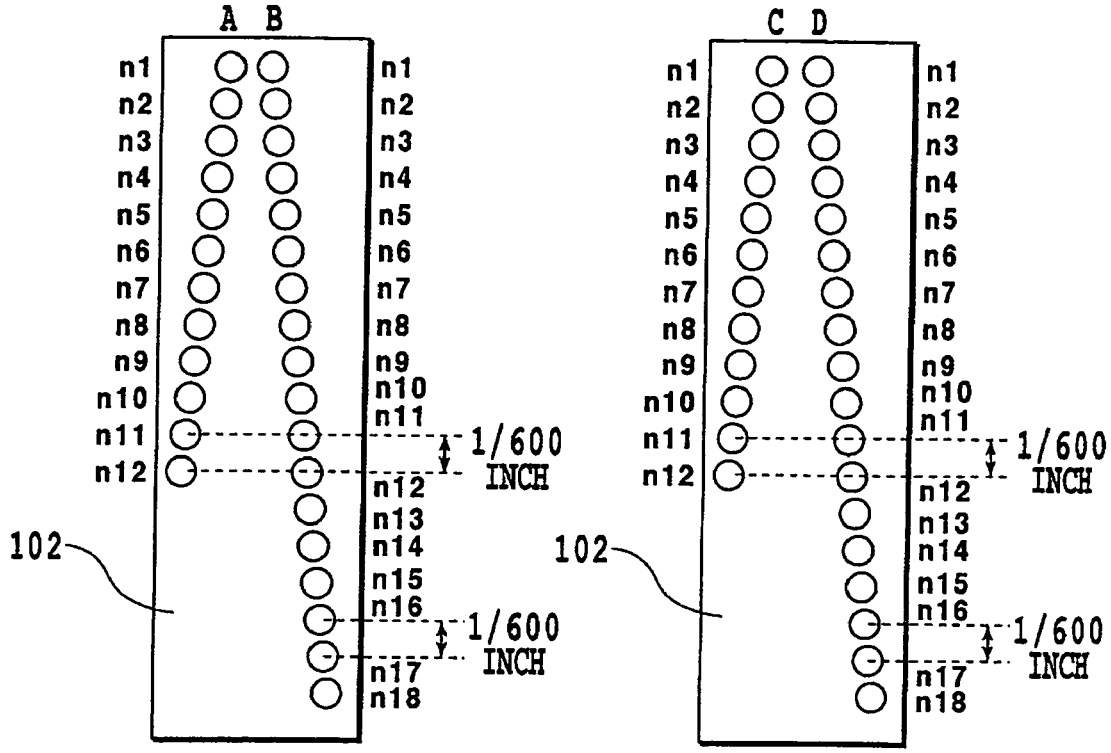
FIG. 37 is a schematic view of two printing heads in which two discharge port rows, which have an arrangement pitch being applicable to the present invention and which have different number of discharge ports, are respectively arranged.
Figure 37:
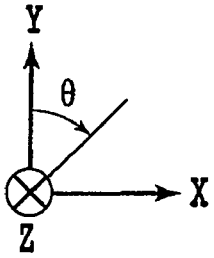

FIG. 37 shows two printing heads in which two discharge port rows having different number of discharge ports are respectively arranged. In FIG. 37, twelve discharge ports are arranged at 1/600-inch intervals in discharge port rows A and B, while eighteen discharge ports are arranged in discharge port rows B and D. Even in such a case, in the discharge port rows B and D, by dividing n1 to n18 of the discharge ports into two groups of n1 to n9 and n10 to n18 of the discharge ports, or into three groups of n1 to n6, n7 to n12, and n13 to n18 of the discharge ports, inclinations in the discharge port rows can be corrected similarly to the above-described embodiments.

As described above, the configuration and method of the present invention effectively function as long as a printing apparatus is provided with a plurality of discharge port rows no matter what an arrangement pitch or the number of discharge ports is. However, by use of FIG. 13, the above descriptions have been given by the configuration in which the plurality of discharge ports are evenly divided into the plurality of groups, but the present invention is not limited to such a configuration.

Figure 38A:
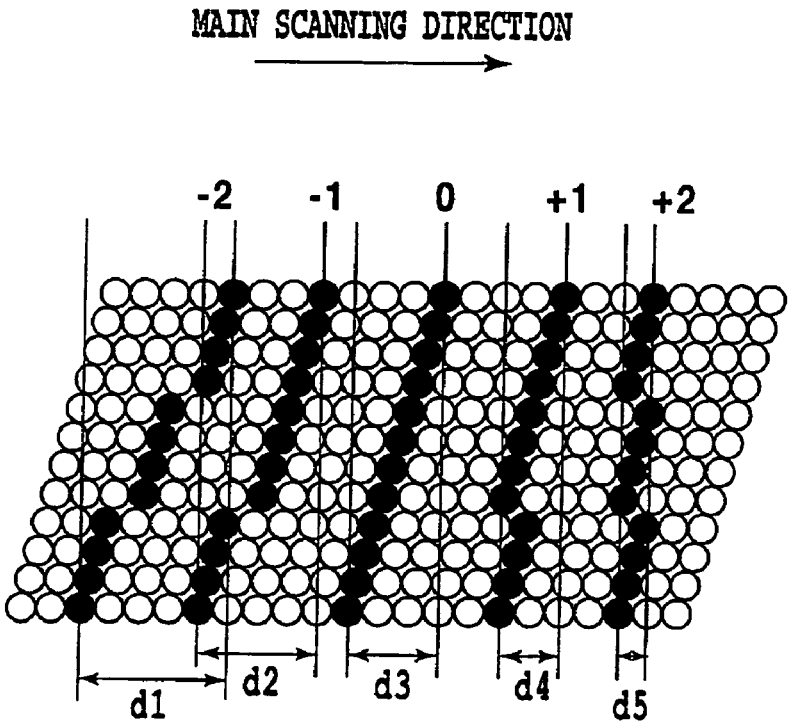
FIGS. 38A and 38B are schematic views for describing another example of the second check patterns.
Figure 38B:
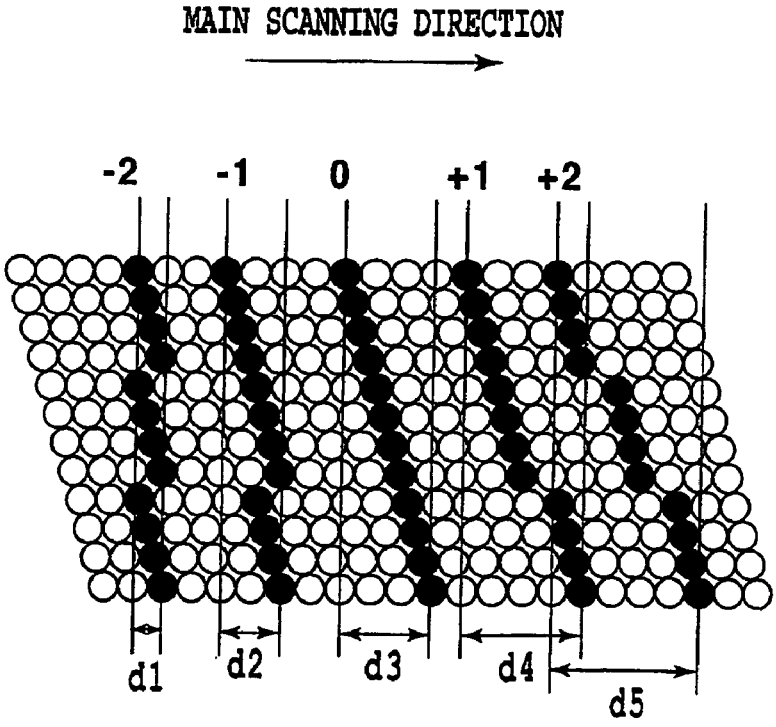

FIGS. 38A and 38B show schematic views showing other examples of the second check patterns shown in FIGS. 12A and 12B. Here, when twelve discharge ports are divided into two groups to form the patterns of +1 and −1, the discharge ports are divided into a discharge port group of eight discharge ports n1 to n8 and a discharge port group of four discharge ports n9 to n12. In this manner, even though the number of the discharge ports included in each discharge port group is not always equal, as long as discharge can be carried out while shifting timing with respect to one another in respective discharge port groups divided by a predetermined method, effects similar to the above-described embodiments can be obtained.

Incidentally, to print check patterns in which printing positions are each shifted by one pixel, divided discharge by discharge port groups as described above is not always needed. The above-described check patterns are stored in the memory in the printing apparatus or the host device connected to the printing apparatus. Therefore, the above-described position adjusting modes can normally function as long as the data are stored as the data each shifted by one pixel.

In addition, the confirmation of the check patterns and the entry of the setting values are also not necessarily carried out by the user. For example, by including an optical sensor or the like in the printing apparatus for detecting a state of patterns, the processes of confirmation, selection, and entry by the user can be automatically carried out. By this way, image deterioration or the like due to an entry error or the like can be further suppressed.

Moreover, as for the accuracy of the printing position alignment, it is also assumed in the above embodiments that printing position displacement to be generated on a pixel-by-pixel basis is corrected on a pixel-by-pixel basis, but the present invention is not limited to this. Actual printing position displacement is not generated on a pixel-by-pixel basis, and there is a case where displacement of not more than one pixel can affect an image. Even in such a case, a more preferable image can be obtained when position alignment can be carried out with higher accuracy by any means (for example, on a ½ pixel basis, on a ⅓ pixel basis, or the like).

In addition, in the forgoing, as a specific example of check patterns, patterns for checking linearity of a ruler line printed by each discharge port row are applied, but the present invention is not limited to this. Conventionally, a several test patterns for determining displacement or an inclination of printing positions have already been proposed. Whatever the patterns are, the patterns can be applied to the present invention as long as the patterns can effectively function to determine a proper printing position. A characteristic of the present invention is that different kinds of printing position displacement such as an inclination in each discharge port row and printing positions among respective discharge port rows can be sequentially corrected in different phases. Therefore, even in a case where check patterns having different features in each correction are applied, the effects of the present invention are not changed at all. As long as a proper correction value is finally obtained based on the correction value obtained in each phase, it is included in the scope of the present invention.

It should be noted that, in the foregoing, the inclination of the printing position on the printing medium in the image printed by one discharge port row has been described as attributable to the inclination θ of the discharge port row arranged on the printing head. However, in reality, such an inclination is caused by more various causes.

Figure 39A:
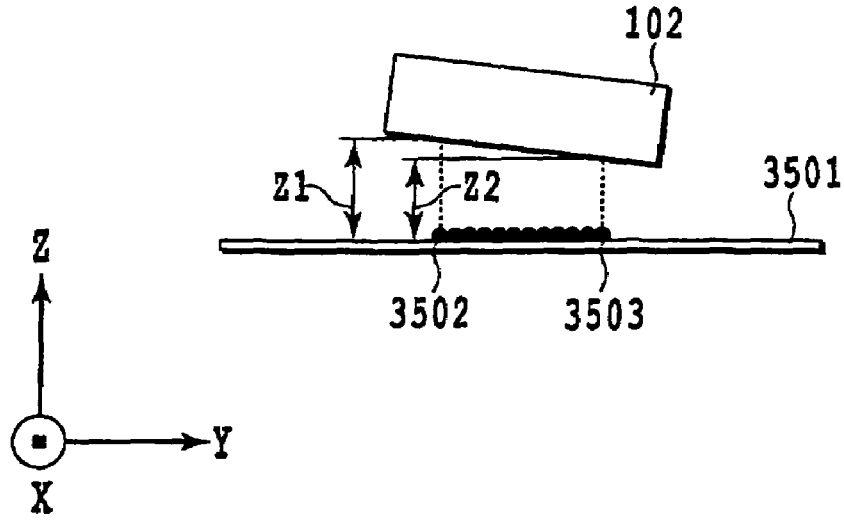
FIGS. 39A and 39B are schematic views for describing another cause of an inclination θ against a printing medium.
Figure 39B:
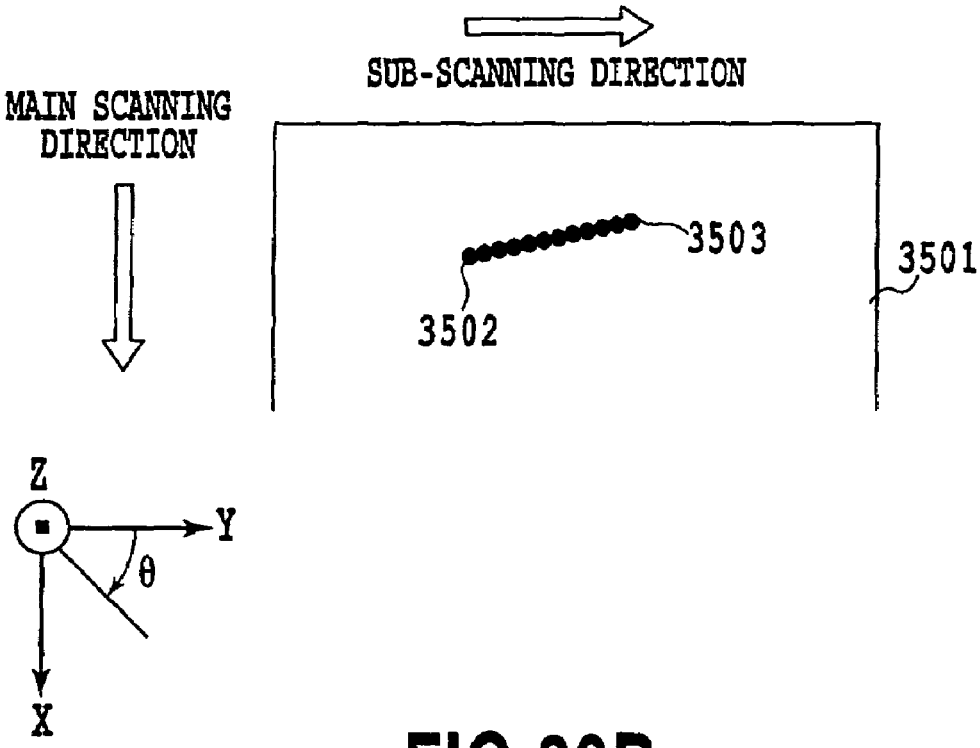

FIGS. 39A and 39B are schematic views for describing another cause generating an inclination θ on the printing medium. In FIG. 39A, reference numeral 102 denotes a printing head, which discharges ink in the −Z direction while moving and scanning in the X direction to a printing medium 3501. At this time, in a case where a mounting position of the printing head above the printing medium is inclined as shown in FIG. 39A, a distance to the printing medium 3501 (hereinafter referred to as a distance to paper) is varied according a position where discharge ports are arranged, even in a single discharge port row. In FIG. 39A, when a distance to paper of the discharge port positioned at the leftmost is assumed to be Z1 and a distance to paper of the discharge port positioned at the rightmost is assumed to be Z2, it follows: Z1>Z2. In such a state, a timing gap is caused when ink droplets reach the printing medium 3501 even when ink is discharged from each discharge port at the same timing. That is, the ink droplet 3502 discharged from the discharge port larger in the distance to paper is placed on the printing medium after the ink droplet 3503 discharged from the discharge port smaller in the distance to paper. Since the printing head 102 is moving and scanning at a constant speed in the X direction at the time of discharging, this difference between droplet placement timing appears as printing position displacement to the X direction as if an inclination is included in the discharge port row as shown in FIG. 39B.

Figure 40:
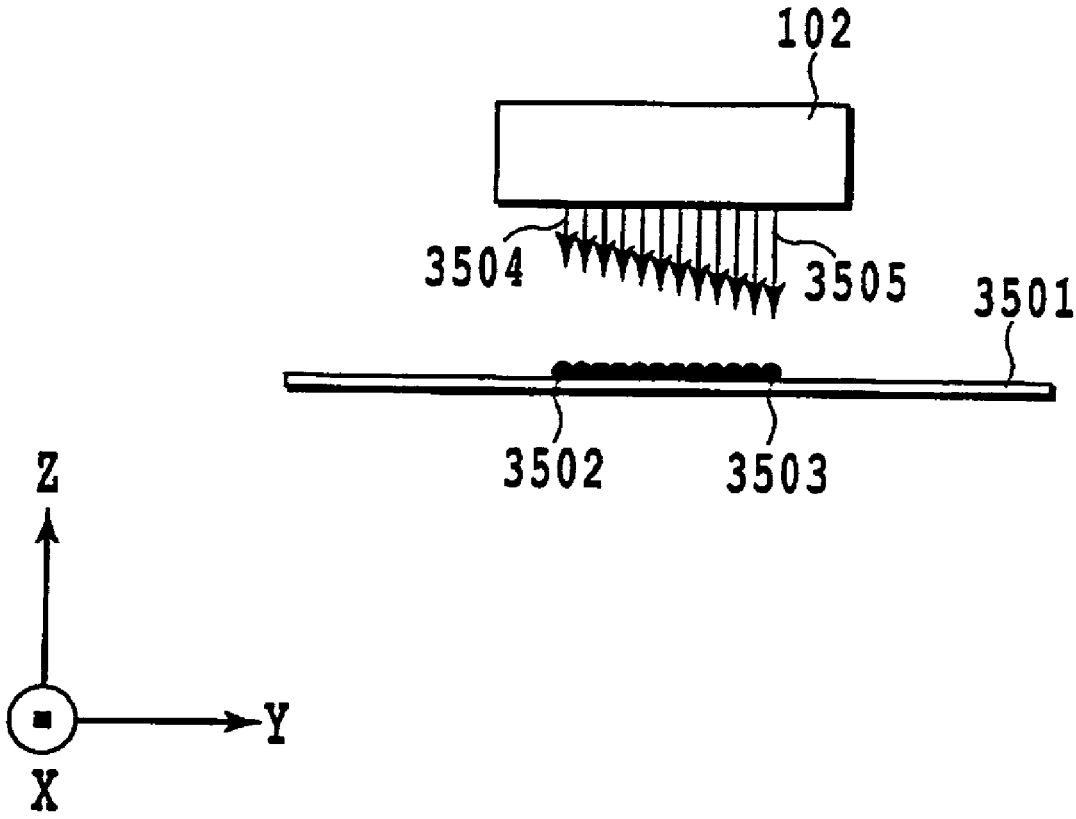
FIG. 40 is a schematic view for describing still another cause of an inclination θ against a printing medium.

FIG. 40 is a schematic view for describing still another cause generating an inclination θ on the printing medium. In FIG. 40, the printing head 102 discharges ink in the −Z direction while moving and scanning in the X direction to the printing medium 3501. In FIG. 40, shown is a state where various discharging speeds are included among respective discharge ports in the single discharge port row. An ink droplet 3504 discharged from the discharge port positioned at the left end in FIG. 40 is discharged at the slowest speed, and an ink droplet 3505 discharged from the discharge port positioned at the right end in FIG. 40 is discharged at the fastest speed. In such a case, even though the distance to paper from each discharge port is equal, timing of the ink droplets to reach the printing medium 3501 is shifted. That is, the ink droplet 3504, which is slower in discharging speed, is placed on the printing medium after the ink droplet 3505, which is faster in discharging speed. Since the printing head 102 is moving and scanning in the X direction at a constant speed at the time of discharging, this difference between droplet placement timing appears as printing position displacement to the X direction as if an inclination is included in the discharge port row as shown in FIG. 39B.

Figure 41:
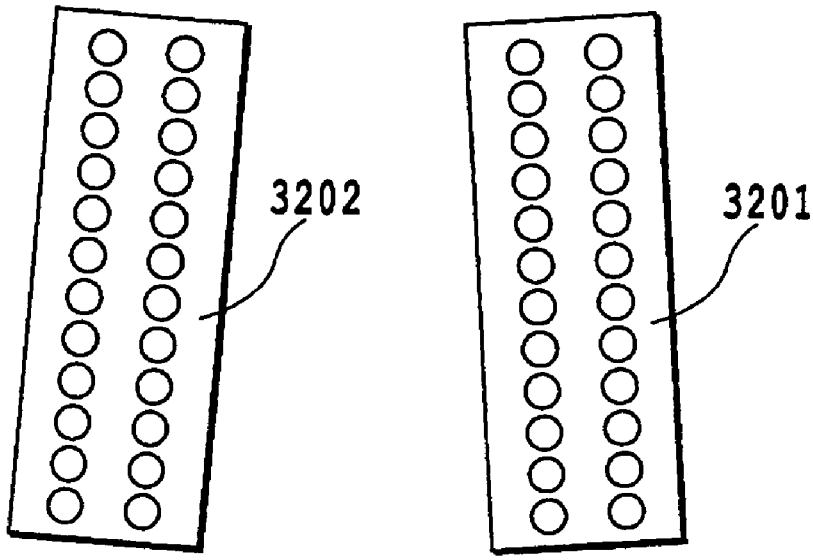
FIG. 41 is a schematic view for describing still another cause of an inclination θ against a printing medium.
Figure 41:
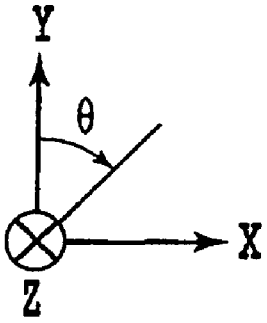

FIG. 41 is a schematic view for describing still another cause generating an inclination θ on the printing medium. In FIG. 41, reference numerals 3201 and 3202 denote printing heads, which are fixed to the main body of the printing apparatus in a state of including the inclinations as shown in FIG. 41. In this manner, even in a state where each discharge port row per se does not include an inclination against the printing head, there is a case where an inclination is generated at the time of mounting the printing head on the printing apparatus.

Even though the generation of an inclination θ in an image to be formed on the printing medium is caused by any of the causes described in, for example, FIGS. 39, 40 and 41, the method described in the above-mentioned embodiments can effectively function.

It should be noted that, in the above-mentioned descriptions, an inkjet printing apparatus has been described as an example since the effects of the present invention on the problems to be solved by the present invention are likely to appear conspicuously. However, the present invention is not limited to such a printing method. As long as a printing head, in which a plurality of printing elements being able to apply color agents onto a printing medium is arranged, is used, and a printing apparatus for forming an image on a printing medium by the dot matrix method is used, the present invention is effective and the effects thereof can be obtained whatever means to apply printing agents is used. In the above-described embodiments, a discharge port being able to discharge ink as a droplet has merely been described as one printing element, and a discharge port row formed by arranging a plurality of discharge ports has merely been described as a printing element row.

The present invention has been described in detail with respect to preferred embodiments, and it will now be apparent from the foregoing to these skilled in the art that changes and modification may be made without departing from the invention in its broader aspects, and it is the intention, therefore, that the appended claims cover all such changes and modifications as fall within the true spirit of the invention.

This application claims priority from Japanese Patent Application No. 2005-200147 filed Jul. 8, 2005, which is hereby incorporated by reference herein.

What is claimed is:

1. A printing apparatus for forming an image by moving a plurality of printing element rows relatively to a printing medium, each of the printing element rows being formed by arranging a plurality of printing elements applying color agents onto the printing medium, comprising:

first printing means for printing a plurality of first check patterns using a predetermined one of the plurality of printing element rows, each of the first check patterns being printed with a plurality of printing element groups which make up the predetermined printing element row at applying timings shifted by specified times, the specified times for printing each of the plurality of first check patterns being different from one another;

first adjusting means for obtaining a first adjustment value for adjusting printing positions among a plurality of printing elements included in the predetermined printing element row, the first adjustment value being obtained correspondingly to one of the first check patterns;

second printing means for printing a plurality of second check patterns using at least two predetermined printing element rows, each of the second check patterns being printed at applying timings shifted by specified times among the at least two predetermined printing element rows, the specified times for printing each of the second check patterns being different from one another; and second adjusting means for obtaining a second adjustment value for adjusting printing positions among the at least two predetermined printing element rows, the second adjustment value being obtained correspondingly to one of the second check patterns, wherein said second printing means prints the second check patterns using the first adjustment value obtained by said first adjusting means.

2. The printing apparatus according to claim 1, wherein the plurality of printing element rows apply color agents of mutually different types onto the printing medium.

3. The printing apparatus according to claim 1, wherein the plurality of printing element rows are formed in a single printing head.

4. The printing apparatus according to claim 1, wherein the plurality of printing element rows are formed in a plurality of printing heads.

5. The printing apparatus according to claim 1, wherein said first adjusting means sets a value determined by the first check patterns printed on a printing medium as the first adjustment value, and said second adjusting means sets a value determined by the second check patterns printed on the printing medium as the second adjustment value.

6. The printing apparatus according to claim 5, wherein the second check patterns are printed based on the first adjustment value.

7. The printing apparatus according to claim 5, wherein the determination is carried out by a user.

8. The printing apparatus according to claim 5, further comprising means for detecting the first and the second check patterns, wherein the determination is carried out according to a read value by the detecting means.

9. The printing apparatus according to claim 5, further comprising means for storing printing data of the first and the second check patterns.

10. The printing apparatus according to claim 5, wherein the printing data of the first and the second check patterns are supplied from a device externally connected.

11. A method of adjusting printing positions of a printing apparatus for forming an image by moving a plurality of printing element rows relatively to a printing medium, each of the printing element rows being formed by arranging a plurality of printing elements applying color agents onto the printing medium, comprising the steps of:

printing first check patterns using a predetermined one of the printing element rows, each of the first check patterns being printed with a plurality of printing element groups which make up the predetermined printing element row at applying timings shifted by specified times, the specified times for printing each of the plurality of first checking patterns being different from one another;

obtaining a first adjustment value for adjusting printing positions among a plurality of printing elements included in the predetermined printing element row, the first adjustment value being obtained correspondingly to one of the first check patterns;

printing second check patterns using at least two predetermined printing element rows, each of the second check patterns being printed at applying timings shifted by specified times among the at least two predetermined printing element rows, the specified times for printing each of the second check patterns being different from one another; and obtaining a second adjustment value for adjusting printing positions among the at least two predetermined printing element rows, the second adjustment value being obtained correspondingly to one of the second check patterns, wherein the second check patterns are printed using the first adjustment value.

* * * * *

UNITED STATES PATENT AND TRADEMARK OFFICE

CERTIFICATE OF CORRECTION

PATENT NO. : 7,296,872 B2
APPLICATION NO. : 11/477348
DATED : November 20, 2007
INVENTOR(S) : Hayashi et al.

It is certified that error appears in the above-identified patent and that said Letters Patent is hereby corrected as shown below:

COLUMN 3:
Line 18, “while” should read --white--.

COLUMN 12:
Line 58, “phase” should read --phased--.

COLUMN 14:
Line 7, “arrange” should read --arranged--.

COLUMN 17:
Line 59, “arrange” should read --arranged--.
Line 61, “arrange” should read --arranged--.

COLUMN 19:
Line 31, “according” should read --according to--.

COLUMN 20:
Line 36, “these” should read --those--.

Signed and Sealed this

Third Day of March, 2009

JOHN DOLL
*Acting Director of the United States Patent and Trademark Office*